US007169065B2

(12) United States Patent
Ninomiya et al.

(10) Patent No.: US 7,169,065 B2
(45) Date of Patent: Jan. 30, 2007

(54) MULTI-PIECE GOLF BALL AND MANUFACTURING METHOD THEREOF

(75) Inventors: Norikazu Ninomiya, Osaka (JP); Kenji Onoda, Kashihara (JP); Masao Ogawa, Osaka (JP); Yuri Naka, Katano (JP)

(73) Assignee: Mizuno Corporation (JP)

( * ) Notice: Subject to any disclaimer, the term of this patent is extended or adjusted under 35 U.S.C. 154(b) by 59 days.

(21) Appl. No.: 10/767,008

(22) Filed: Jan. 30, 2004

(65) Prior Publication Data

US 2004/0192471 A1 Sep. 30, 2004

Related U.S. Application Data

(62) Division of application No. 10/339,411, filed on Jan. 10, 2004.

(51) Int. Cl.
*A63B 37/08* (2006.01)
*A63B 37/04* (2006.01)

(52) U.S. Cl. ..... 473/370; 473/376

(58) Field of Classification Search ..... 473/351–378
See application file for complete search history.

(56) References Cited

U.S. PATENT DOCUMENTS

| | | | |
|---|---|---|---|
| 4,173,345 | A | 11/1979 | Pocklington |
| 4,660,830 | A | 4/1987 | Tomar |
| 5,692,973 | A | 12/1997 | Dalton |
| 5,836,834 | A | 11/1998 | Masutani et al. |
| 6,039,910 | A | 3/2000 | Tanaka et al. |
| 6,126,560 | A | 10/2000 | Maruoka et al. |
| 6,213,893 | B1 | 4/2001 | Maruko et al. |
| 6,217,462 | B1 | 4/2001 | Maruko et al. |
| 6,296,578 | B1 | 10/2001 | Masutani |
| 6,398,667 | B1 | 6/2002 | Lemons |
| 6,835,146 | B2 * | 12/2004 | Jordan et al. ..... 473/377 |

FOREIGN PATENT DOCUMENTS

| | | |
|---|---|---|
| JP | 1965-3456 | 1/1940 |
| JP | 1974-136364 | 3/1948 |
| JP | 1985-241463 | 11/1985 |
| JP | 62-73932 | 4/1987 |
| JP | 1998-337340 | 12/1998 |
| JP | 2000-288122 | 10/2000 |
| JP | 2001-112889 | 4/2001 |
| JP | 2001-112890 | 4/2001 |
| JP | 2001-340493 | 12/2001 |

* cited by examiner

*Primary Examiner*—Eugene Kim
*Assistant Examiner*—Alvin A. Hunter, Jr.
(74) *Attorney, Agent, or Firm*—Stites & Harbison PLLC; Marvin Petry

(57) ABSTRACT

This invention relates to a multi-layered, multi-piece golf ball that comprises a core, an intermediate layer, and a cover, wherein the core comprises a spherical body and ribs that are arranged on the surface of the spherical body and that have almost the same height as the thickness of the intermediate layer, wherein the intermediate layer fills a plurality of concave portions formed on the surface of the spherical body while being surrounded by the ribs. This arrangement enables the golf ball to have both high ball bounce resilience and a soft feel when hit.

7 Claims, 19 Drawing Sheets

(a)

(b)

(a)

(b)

(a)

(b)

(a)

(b)

(a)

(b)

(a)

(b)

MULTI-PIECE GOLF BALL AND MANUFACTURING METHOD THEREOF

This is a divisional of application Ser. No. 10/339,411, filed Jan. 10, 2004.

BACKGROUND OF THE INVENTION (1) Field of the Invention

The present invention relates to a multi-piece golf ball having a multi-layered structure and to a method for manufacturing the same.

(2) Description of the Related Art

Recently, several golf balls exhibiting both high ball bounce resilience and a soft feel when hit have been proposed. One example of such golf balls is multi-piece golf ball in which the ball is composed of a plurality of layers. Generally, in a multi-layered golf ball, especially in a golf gall that has three or more layers, a highly rigid core is covered with an intermediate layer that has relatively low rigidity, and the outer surface of the intermediate layer is covered with a hard cover. This arrangement aims to attain both high ball bounce resilience and a soft feel when hit by using the rigidity of the core and the softness of the intermediate layer.

However, in such a multi-layered golf ball, when the ball is hit, the intermediate layer is depressed in the portion that received the strike. The ball then rolls while being deformed not only in the layer's thickness direction but also in the direction along the spherical surface, and therefore the striking force tends to be dispersed in the direction along the spherical surface. This poses a problem such that, although a soft feel when hit can be obtained, high ball bounce resilience is difficult to obtain.

In manufacturing a multi-layered golf ball, it is important to accurately form each layer concentrically. Therefore, for example, in a three-layered golf ball that comprises a core, an intermediate layer, and a cover, a manufacturing method explained below has been proposed.

First, a core that will become the center of the ball is molded. Then, a pair of hemispherical, shell-like pieces for forming the intermediate layer are molded in a semi-vulcanized condition. Then, these pieces for forming the intermediate layer are set in the mold, the core that has been molded in advance is inserted therein, and all are subjected to full vulcanization by press molding. Thereby, the core will be arranged in the intermediate layer. Thereafter, a cover is molded onto the outer side of the intermediate layer by injection molding or the like.

However, in this manufacturing method, the core is held by the pieces for intermediate layer that are in a semi-vulcanized condition, and therefore the core may be displaced from the center of the ball. This makes it difficult to concentrically align the core and the intermediate layer in an accurate manner.

Alternatively, the following manufacturing method has been proposed. A core, which will become the center of the ball, is press molded and placed in a mold for the intermediate layer. The mold is provided with holding pins that are designed so as to be able to move forward or backward while being inserted in a plurality of holes that are connected to the cavity of the mold. By holding the core with the holding pins that are projected from the holes, the core and the intermediate layer are concentrically aligned. Then, the material that will form the intermediate layer is poured into the mold and the holding pins are removed from the cavity of the mold just before the material is completely cured. Here, the material for forming the intermediate layer is in the condition just before being completely cured and exhibits quite a high hardness, therefore allowing the position of the core to be retained. Then, by covering the completely cured intermediate layer with a cover, it is possible to obtain a golf ball in which the core and other layers are concentrically aligned with accuracy.

However, the mold and the unit for controlling the holding pins in this method become complicated, increasing the manufacturing cost. Furthermore, in this method, it is difficult to adjust the clearance between the holes of the cavity and the holding pins. If the clearance is too small, it becomes difficult to smoothly move the holding pins in the forward or backward direction; on the other hand, if the clearance is too large, the intermediate layer will flow from the gaps between the holes and holding pins.

The present invention aims to solve the above problems. The first object of the present invention is to provide a multi-piece golf ball having both high ball bounce resilience and a soft feel when hit.

The second object of the present invention is to provide a multi-layered, multi-piece golf ball in which the accurately concentric alignment of the core with respect to the intermediate layer is readily achieved, and a method for manufacturing the same.

BRIEF SUMMARY OF THE INVENTION

In order to achieve the above objects, the present invention provides a multi-layered, multi-piece golf ball comprising a core, an intermediate layer, and a cover, wherein the core is provided with a spherical body and ribs that have almost the same height as the thickness of the intermediate layer and are arranged on the surface of the spherical body. In the plurality of concave portions bordered by the ribs, the intermediate layer fills the space between the surface of the spherical body and the cover.

In this structure, the intermediate layer fills the plurality of concave portions that are divided and partitioned by the ribs, and therefore, when the ball is hit, a portion of the striking force is transferred from the highly rigid ribs to the core, and the rest of the striking force thereof is transferred to the core through the soft intermediate layer. In the portion of the intermediate layer that received the strike, the ribs limit the movable range of deformation in the spherical surface direction, and therefore it is possible to prevent the striking force from being dispersed in the direction along the spherical surface. As described above, a portion of the striking force is efficiently transferred to the spherical body of the core by the highly rigid ribs, and the rest of the striking force thereof is transferred to the spherical body of the core through the soft intermediate layer, which has a limited deformation range. As a result, it is possible to obtain both high ball bounce resilience and a soft feel when hit.

The multi-piece golf ball can be so structured that the ribs are uniformly formed on the surface of the spherical body. This makes it possible to obtain almost the same ball bounce resilience and a soft feel regardless the direction from which the ball is hit.

The multi-piece golf ball can be structure so that the ribs are arranged so that the plurality of concave portions have the same shape.

The multi-piece golf ball can be so structured that the ribs are large-diameter ribs that extend along three great circles drawn on the spherical body so as to intersect each other at right angles.

The multi-piece golf ball can be so structured that each rib has a notch or notches so as to form a passageway or passageways between adjacent concave portions.

The ribs can be structured so as to have a trapezoidal profile in their sideways cross-section, wherein the width of the end portion of the rib in the outward radial direction is 1.5 to 2.0 mm and the width of the end portion thereof in the inward radial direction is 3.0 to 6.0 mm. By setting a lower limit on the width of each rib as described above, the ribs can be prevented from being deformed by the filling pressure when filling the concave portions with intermediate layer material. Furthermore, by setting an upper limit thereof as described above, the width of the rib can be prevented from becoming unduly large. Accordingly, it is possible to avoid decreasing the soft feel when the ball is hit can be avoided.

Alternatively, the multi-piece golf ball of the present invention can be structured to be a multi layered, multi-piece golf ball comprising a core, an intermediate layer, and a cover, wherein the thickness of the cover is 0.8 to 2.4 mm; the core being provided with a spherical body and ribs that are disposed on the surface of the spherical body and that have the same height as the thickness of the intermediate layer; the ribs extending along three great circles that are drawn on the spherical body in such a manner as to intersect each other at right angles, and the height of the ribs being 1.2 to 4.6 mm; with each circular arc section of the ribs divided at the intersections of the great circles and provided with a notch; the length of each upper end portion of the circular arc section without a notch being 10 mm or greater and the depth of the notch being 1.2 mm or greater; and, in the eight concave portions that are surrounded by the ribs, the intermediate layer fills the space between the surface of the spherical body and the cover.

Also in this golf ball, notches are formed as described above. However, if the size of the notch is unduly large, the limitation of the movable range of the intermediate layer upon being hit becomes insufficient and a high ball bounce resilience cannot be obtained. Therefore, in this invention, the length of the upper end portion of each circular arc section without a notch should be no smaller than 10 mm. On the other hand, if the notch is too small, it becomes difficult to spread the intermediate layer material to the adjacent concave portion. Therefore, in the above invention, the depth of the notch is set not smaller than 1.2 mm.

The notch can be formed into various shapes, including the following example. That is, the notch can have a plane that extends from one point of the normal line of the spherical body (a line perpendicular to the tangent plane) passing through the intersection of the great circles toward the circular arc section, wherein the plane has an angle that is not smaller than 90° relative to the normal line. Thereby, the four concave portions that are arranged so as to have their center at the intersection of the great circles are made to communicate with each other, and the material for the intermediate layer can be readily spread. Here, it is preferable that the angle made between the plane and the normal line be 91 to 93°. This arrangement enables the above angle to serve as a draft angle, and, for example, when a core is molded using two molds, such as an upper mold and a lower mold, the core can easily be removed from the mold.

It is also possible to form a notch in the middle of the circular arc section in the circular direction. This enables two adjacent concave portions to communicate with each other.

Here, it is preferable that the notch have two planes that each extend toward the intersection from one point on the normal line of the spherical body that passes through the mid point of each circular arc section in the circular direction, wherein the angle made between the plane and the normal line be 45 to 48°. Alternatively, it is also possible to arrange the notch to have the side faces disposed along the two planes that each extend toward the intersection side from one point on the normal line of the spherical body that passes through the mid point of each circular arc section in the circular direction, and a base that connects the two side faces, wherein the angle made between each side face and the normal line is 45 to 48°. This arrangement allows the above angle to serve as a draft angle, and, for example, when a core is molded using two molds, i.e., an upper mold and a lower mold, the core can be removed from the mold easily.

In order to achieve the second object, the present invention provides a method for manufacturing the multi-piece golf ball, which comprises a first process of molding the core; a second process in which a pair of hemispherical, shell-like pieces for forming the intermediate layer that are composed of a rubber composition are molded into a semi-vulcanized condition by press molding; a third process in which the core is placed between the pair of pieces for forming the intermediate layer, the edges of the mouths of the pair of pieces for forming the intermediate layer are made to contact each other, and the pieces for forming the intermediate layer are subjected to full vulcanization by press molding; and a fourth process of providing a cover on the outer surface of the intermediate layer obtained by the full vulcanization.

In this method, the core is inserted between the semi-vulcanized pair of pieces for forming the intermediate layer, which are made of a rubber composition formed into a hemispherical shell-like shape, and then full vulcanization and press molding are conducted. Therefore, the core and the intermediate layer can concentrically aligned in an accurate manner. In other words, according to this manufacturing method, the intermediate layer is made to cover the core by press molding that combines a semi-vulcanization step and a full vulcanization step. Therefore, there is no need for the complicated manufacturing apparatus that is required in known methods, resulting in a reduction of the production cost.

The second process comprises the steps of preparing a hemispheric upper part and lower part of the mold having concave portions; preparing a middle part of the mold provided with separators having a size that can cover the concave portions of the upper part and lower part of the mold, and a pair of hemispheric convex portions each arranged on the upper surface and the lower surface of the separator that are shaped so as to correspond to the inner surface of the intermediate layer; and molding the pieces for forming the intermediate layer in the semi-vulcanized condition by placing the middle part of the mold between the upper part and lower part of the mold, filling the concave portions of the upper part and lower part of the mold with the material for the intermediate layer, and press molding.

This method makes it possible to obtain the pair of pieces for forming the intermediate layer in a single step. As a result, the manufacturing time can be reduced.

When the notch is formed in the rib as described above, the manufacturing method described below can also be employed. This method comprises a first process of molding the core; a second process of preparing an upper part and lower part of the mold that are provided with hemispheric concave portions; a third process of forming an intermediate layer on the surface of the core by inserting the core between the upper part and lower part of the mold, filling the concave portions of the upper part and lower part of the mold with the material for the intermediate layer that is composed of a rubber composition, conducting press molding so that the material for intermediate layer spreads all over the concave portions through the notches; and a fourth process of providing a cover over the intermediate layer.

This method enables the material for the intermediate layer to spread all over the concave portions through the notches while being pressed, and therefore it is possible to cover the core with the intermediate layer by a single press molding step, reducing the manufacturing time. In this case, in the third process, instead of performing press molding, an intermediate layer can be molded by injection molding after inserting the core between the upper part of the mold and the lower part of the mold.

DETAILED DESCRIPTION OF THE INVENTION

Figure 1:
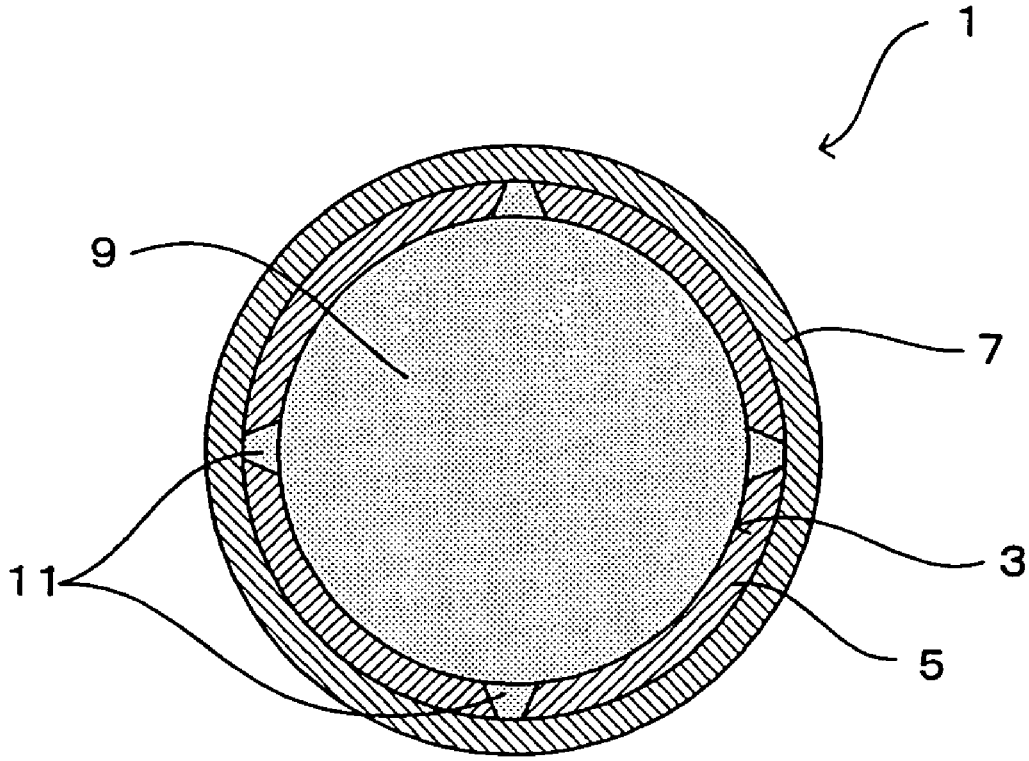
FIG. 1 is a sectional view showing one embodiment of the golf ball of the present invention.

An embodiment of the multi-piece golf ball of the present invention will be explained in more detail below by referring to to the drawings. FIG. 1 shows a sectional view of the golf ball of the present embodiment and FIG. 2 shows a perspective view of the core.

As shown in FIG. 1, a golf ball 1 of the present embodiment is a so-called three-piece golf ball, wherein a core 3 is covered with an intermediate layer 5 and a cover 7. According to the rules (see R&A and USGA), the diameter of the golf ball should be no smaller than 42.67 mm. However, taking aerodynamic characteristics and the like into consideration, it is preferable that the diameter of the ball be as small as possible. Therefore, it can be, for example, 42.7 mm.

Figure 2:
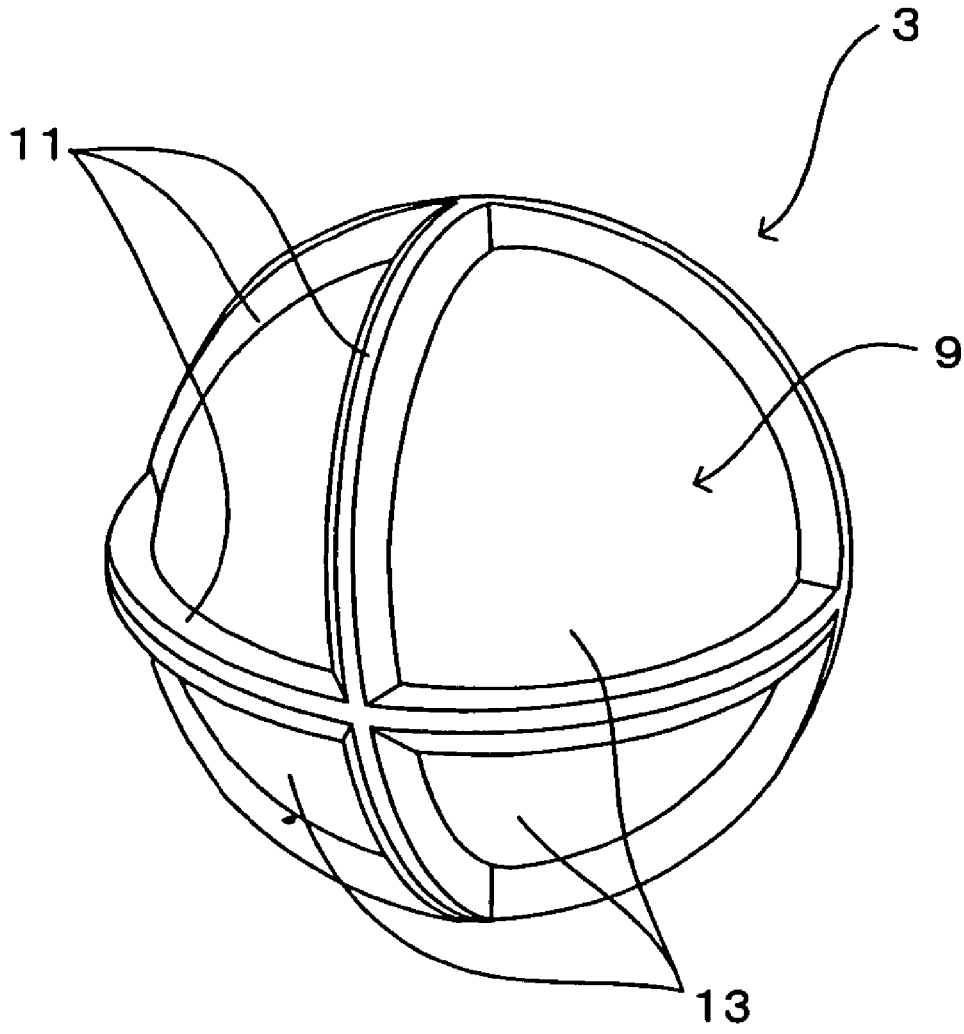
FIG. 2 is a perspective view showing the core of the golf ball of FIG. 1.

The core 3 is made of a rubber composition, and, as shown in FIG. 2, composed of a spherical body 9 and three ribs 11 integrally formed on the surface of the spherical body 9. Each rib 11 extends along three great circles drawn on the spherical body 9 that intersect each other at right angles. These ribs 11 form eight concave portions 13 on the surface of the spherical body 9.

It is preferable that the diameter of the spherical body 9 be 28.7 to 38.7 mm and more preferably 34.7 to 35.9 mm. It is preferable that the height of the ribs be 1.2 to 4.6 mm and more preferably 1.8 to 2.2 mm. This is because the height of the ribs 11 and the thickness of the intermediate layer 5 are almost the same. Therefore, if the height of the ribs 11 becomes smaller than 1.2 mm, the thickness of the intermediate layer 5 becomes too thin, leading to a hard feel when the ball is hit. On the other hand, if it becomes greater than 4.6 mm, the thickness of the intermediate layer 5 becomes too thick, leading to an excessively soft feel when the ball is hit. In order to obtain high ball bounce resilience, it is preferable that the hardness of the core 3 be 68 to 85 on the JIS-C scale.

Figure 3:
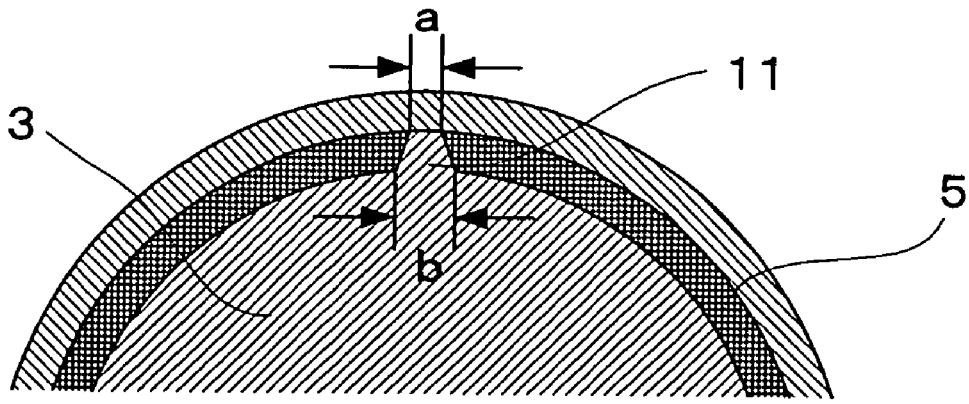
FIG. 3 is a sectional view showing the rib of the golf ball of FIG. 1.

As shown in FIG. 3, the ribs 11 are structured so as to have a trapezoidal profile in their sideways cross-section. It is preferable that the width a of the upper end portion of the ribs 11 in the outward radial direction be 1.5 to 2.0 mm and the width b of the bottom end portion thereof in the inward radial direction be 3.0 to 6.0 mm. As described above, by setting a lower limit for the width of each end portion of the ribs 11, it is possible to prevent the ribs 11 from being deformed by the filling pressure that is attributable to the pressure of closing the mold, when filling the material for the intermediate layer during the manufacturing process. As a result, it is possible to accurately hold the core 3 in the center of the mold. Furthermore, by setting an upper limit for the width of each end portion of the ribs 11 as described above, it is possible to prevent areas where the hard rib and inner surface of the cover 7 are attached to each other from becoming unduly large, and this enables an adequately soft feel when hitting the ball. Note that it is preferable that the widths a, b of each end portion of the rib become wider as the height of the ribs 11 becomes greater. For example, when the height of the ribs 11 is set at 4.6 mm, the width of the bottom end portion b can be set at 6.0 mm.

The core 3 can be manufactured using a known rubber composition comprising a base rubber, a cross-linking agent, a metal salt of unsaturated carboxylic acid, filler, etc. Specific examples of the base rubber include natural rubber, polyisobutylene rubber, styrenebutadiene rubber, EPDM, etc. Among these, it is preferable to use high-cis polybutadiene that contains cis-1,4-bonds in a range of 40% or greater, and preferably 80% or greater.

Specific examples of cross-linking agents include dicumyl peroxide, t-butylperoxide, and like organic peroxides; however, it is particularly preferable to use dicumyl peroxide. The compounding ratio of the cross-linking agent is generally 0.3 to 5 parts by weight, and preferably 0.5 to 2 parts by weight based on 100 parts by weight of the base rubber.

As metal salts of unsaturated carboxylic acids, it is preferable to use monovalent or bivalent metal salts of acrylic acid, methacrylic acid, and like $C_3$ to $C_8$ unsaturated carboxylic acids. Among these, use of zinc acrylate can improve the ball bounce resilience of the ball and is particularly preferable. The compounding ratio of the metal salt of unsaturated carboxylic acid is preferably 15 to 45 parts by weight based on 100 parts by weight of the base rubber. If the compounding ratio thereof is less than 15 parts by weight, the ball bounce resilience is lowered and the carry distance is shortened. On the other hand, if the compounding ratio thereof exceeds 45 parts by weight, the resultant ball becomes too hard and this may decrease the soft feel when hit.

Examples of the filler include those generally added to cores. Specific examples thereof include zinc oxide, barium sulfate, calcium carbonate, etc. The preferable compounding ratio of the filler is 10 to 30 parts by weight based on 100 parts by weight of the base rubber. It is also possible to add an antioxidant, a peptizer, and the like, if necessary.

The intermediate layer 5 is composed of a rubber composition or elastomer and covers the surface of the core 3. As shown in FIG. 1, the intermediate layer 5 has a thickness that is the same as the height of the ribs 11 and fills in the eight concave portions 13 surrounded by the ribs 11, wherein the top portions of the ribs 11 are exposed in the surface of the intermediate layer 5. In order to obtain a soft feel when hit, it is preferable that the hardness of the intermediate layer 5 be 60 to 80 on the JIS-C scale, which is lower than that of the core. When the intermediate layer 5 is composed of a rubber composition, the same materials used for the core 3 described above can be used. However,it is preferable that the compounding ratio of unsaturated carboxylic acids and organic peroxides be reduced in order to make the intermediate layer less hard than the core 3.

When the intermediate layer 5 is formed of an elastomer, it is possible to use, for example, styrene-butadiene-styrene block copolymer (SBS), styrene-isoprene-styrene block copolymer (SIS), styrene-ethylene-butylene-styrene block copolymer (SEBS), styrene-ethylene-propylene-styrene block copolymer (SEPS), and like styrene based thermoplastic elastomers; olefin based thermoplastic elastomers having polyethylene or polypropylene as a hard segment and butadiene rubber or ethylene-propylene rubber as a soft segment; vinyl chloride based plastic elastomers having crystallized poly (vinyl chloride) as a hard segment and amorphous poly (vinyl chloride) or an acrylonitrile butadiene rubber as a soft segment; urethane based plastic elastomers having polyurethane as a hard segment and polyether or polyester urethane as a soft segment; polyester based plastic elastomers having polyester as a hard segment and polyether or polyester as a soft segment; amide based plastic elastomers having polyamide as a hard segment and polyether or polyester as a soft segment; ionomer resins; balata rubber, etc.

As shown in FIG. 1, the cover 7 covers the top portions of the ribs 11 and the intermediate layer 5. On the outer surface of the cover 7, predetermined dimples (not shown) are formed. It is preferable that the thickness of the cover 7 be 0.8 to 2.4 mm, and more preferably 1.6 to 1.8 mm. This is because, if the thickness of the cover 7 becomes less than 0.8 mm, the durability of the cover remarkably decreases and molding thereof becomes difficult. On the other hand, if it exceeds 2.4 mm, the feel when hit becomes too hard. It is preferable that its shore D hardness be 48 to 72. The cover 7 can be composed of known elastomers, and therefore the same elastomers that compose the intermediate layer can be used. Note that the thickness of the cover 7 is defined as the distance from an arbitrary point on the outermost part in the outward radial direction where no dimple is formed to an arbitrary point that comes into contact with the intermediate layer that is measured along the normal line.

In the golf ball 1 that is structured in such a manner as described above, the top portions of the ribs 11 are in contact with the cover 7, and the intermediate layer 5 fills in the eight concave portions 13, which are divided by the ribs 11. Therefore, when the ball 1 is hit, a portion of the striking force is transferred to the core 3 from the highly rigid ribs 11, and the remaining portion thereof is transferred to the core 3 through the soft intermediate layer 5. In the portion of the intermediate layer that received the strike, the ribs limit the movable range of deformation in the spherical surface direction, and therefore it is possible to prevent the striking force from being dispersed in the direction along the spherical surface. As described above, a portion of the striking force is efficiently transferred to the spherical body 9 of the core 3 by the highly rigid ribs 11, and the remaining of the striking force thereof is transferred to the spherical body 9 of the core 3 through the soft intermediate layer 5 having a limited deformation range. As a result, it 5 is possible to obtain both high ball bounce resilience and a soft feel when hit.

The ribs 11 are uniformly formed on the surface of the spherical body 9, and the shape of each concave portion 13 is the same. This makes it possible to obtain almost the same 10 ball bounce resilience and a soft feel when hit regardless of the direction from which the ball is hit. As described below, the ribs 11 also prevent eccentricity between the core 3 and the intermediate layer 5 during the manufacturing process.

Figure 4:
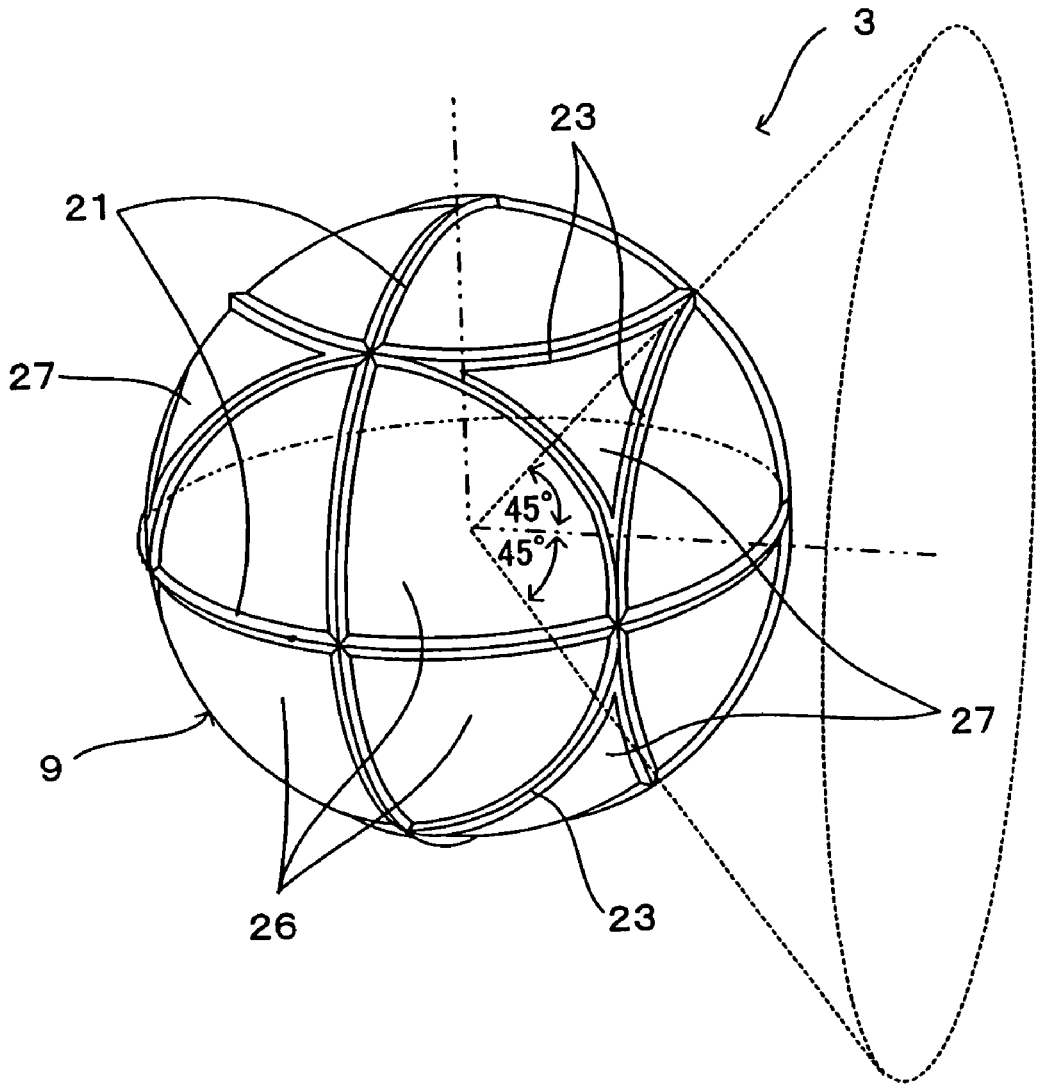
FIG. 4 is a perspective view showing another example of the core of the golf ball of FIG. 1.

In the present embodiment, eight concave portions 13 are formed on the surface of the spherical body 9 by the three ribs 11; however, it is also possible to design the core in the following manner to increase the number of concave portions. As shown in FIG. 4, the core 3 is provided with three large-diameter ribs 21 arranged on the same locations as the ribs 11 shown in FIG. 2 and small-diameter ribs 23 on both sides of each large-diameter rib 21. These ribs 21, 23 are formed so as to have a triangular profile in their sideways cross-section. Specifically, each small-diameter rib 23 lies along the small circle that is drawn where the spherical body 9 intersect with six cones that are drawn to extend outward from their origin at the center of the spherical body 9, with each cone having a half-apex angle of 45° relative to the three axes that intersect each other at right angles. Thereby, on the surface of the spherical body 9, twenty-four fan-shaped concave portions 26 and eight triangular concave portions 27 are formed by the three large-diameter ribs 21 and six small-diameter ribs 23. In this core 3, by arranging the ribs 21, 23 to have a triangular profile in its sideways cross-section, it is possible to prevent the total volume of the ribs from becoming unduly large even though the number of ribs is increased. It is thus possible to prevent a decrease in volume of the intermediate layer 5 that fills the concave portions 25, 27.

When the number of concave portions filled with the intermediate layer increases, the range of movement of the intermediate layer 5 due to deformation is further limited, which is advantageous for obtaining higher ball bounce resilience.

The number of ribs, their locations, and their profile shapes are not limited to the above examples and can be selected depending on the soft feel when hit or ball bounce resilience required in the golf ball. It is preferable that the ribs be uniformly formed on the surface of the spherical body 9. For example, it is possible to arrange the ribs so that each concave portion becomes a regular dodecahedron formed by twelve pentagons or a regular icosahedron formed by twenty triangles.

Figure 5:
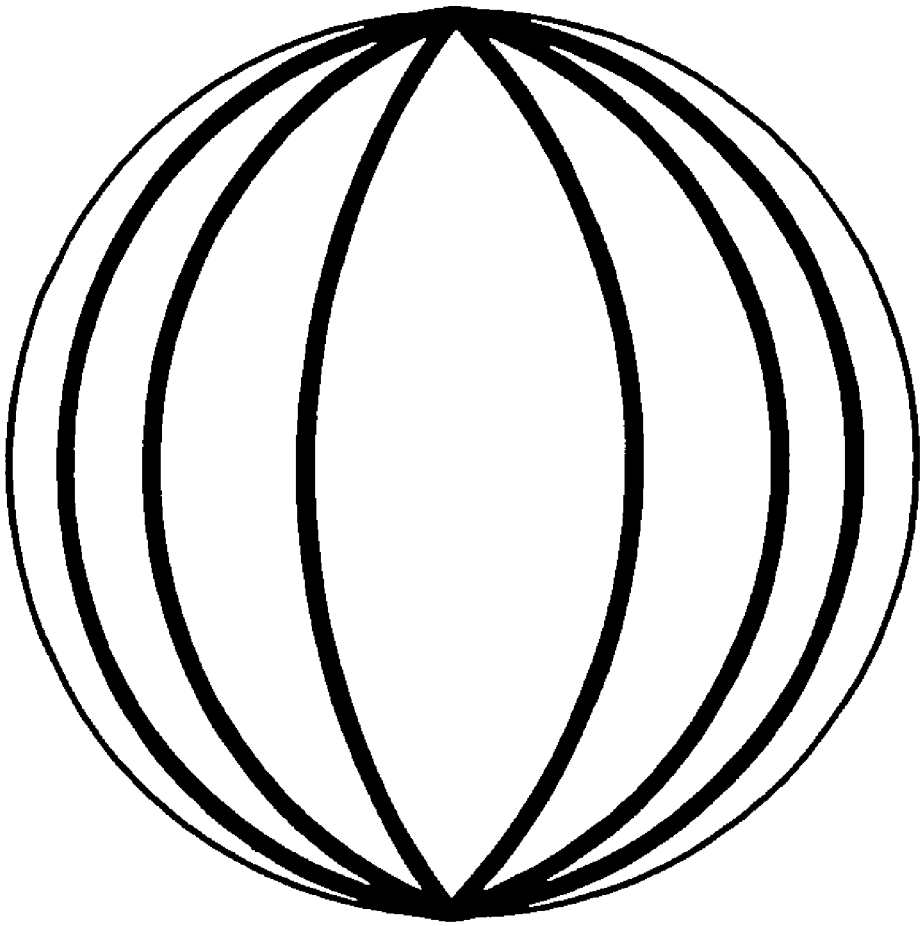
FIG. 5 illustrates an example of an undesirable structure of the rib.

A uniform arrangement of the ribs merely means the condition in which the ribs are not concentrated in a particular area, and therefore, it includes such an arrangement as shown in FIG. 4 in which the ribs are not disposed in a perfectly uniform manner. For example, if the ribs are structured as shown in FIG. 5, the intersections of the ribs concentrate in the upper and lower portions of the figure, and the the soft feel when hit and ball bounce resilience become uneven, thus being undesirable. In this respect, for example, in the core 3 shown in FIG. 4, the half-apex angle of the cone forming the small diameter rib 23 is not limited to 45° and can be selected in the range, for example, of 30° to 45°. Furthermore, it is also possible to provide only small-diameter ribs 23 without large-diameter ribs 21.

Figure 6:
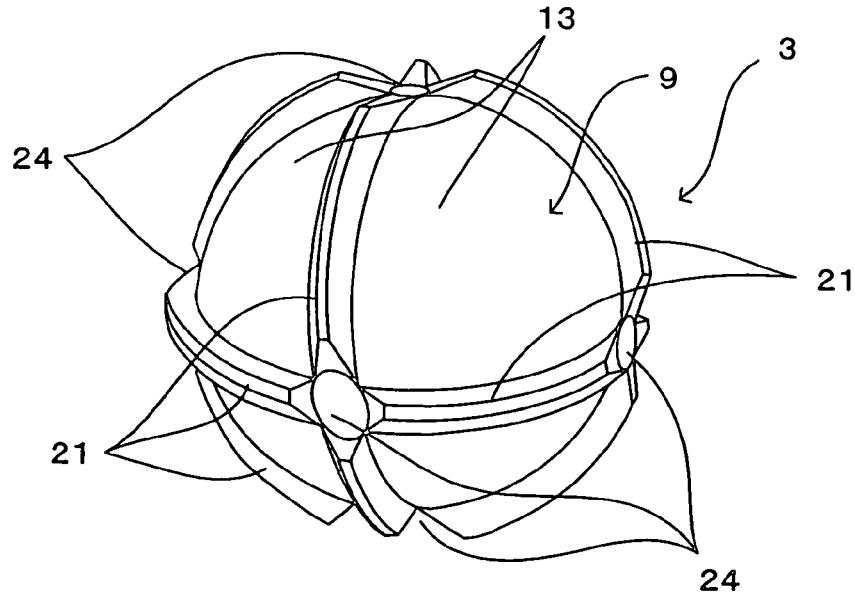
FIG. 6 is a perspective view illustrating another example of the core of the golf ball of the present invention.
Figure 6:
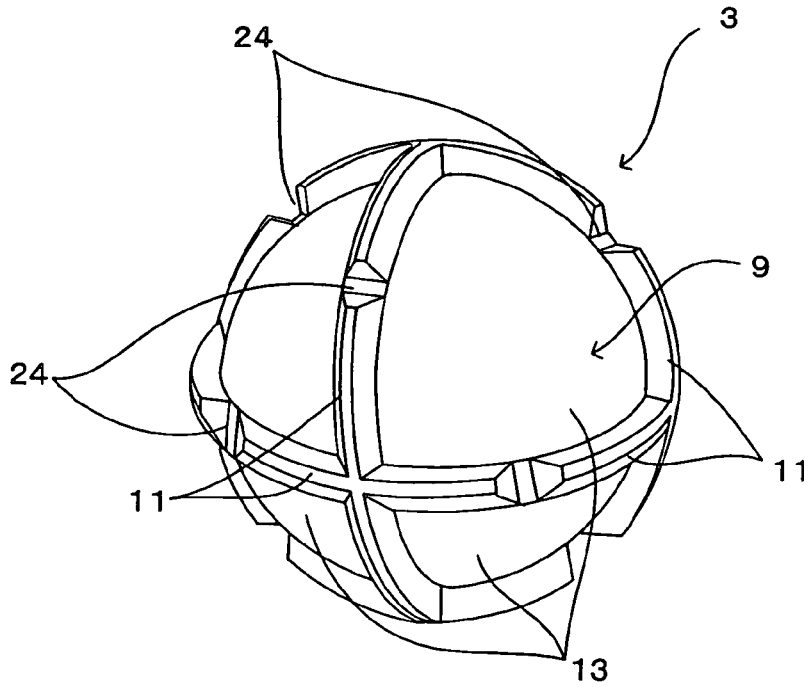

As shown in FIG. 6, it is also possible to provide notches 24 in the ribs 11 so that a passageway is formed between the adjacent concave portions 13. For example, as shown in FIG. 6(*a*), the notches 24 can be formed at the intersections of the ribs to make four concave portions 13 communicate with each other. Alternatively, as shown in FIG. 6(*b*), it is also possible to form the notches 24 in the middle of the ribs 11 so that the two adjacent concave portions 13 can commutate with each other. Providing notches 24 on the ribs 11 is advantageous in that, as described below, it allows the intermediate layer 5 to be molded in a single step.

In the case where the mold for core 3 is composed of two parts, i.e., an upper part of the mold and a lower part of the mold, when the notches 24 are formed in the ribs 11, it is preferable that the notches 24 be formed in the following manner to make mold-releasing easier. The following described an example wherein a core with eight concave portions 13 is formed by providing ribs along three great circles on the spherical body 9.

Figure 7:
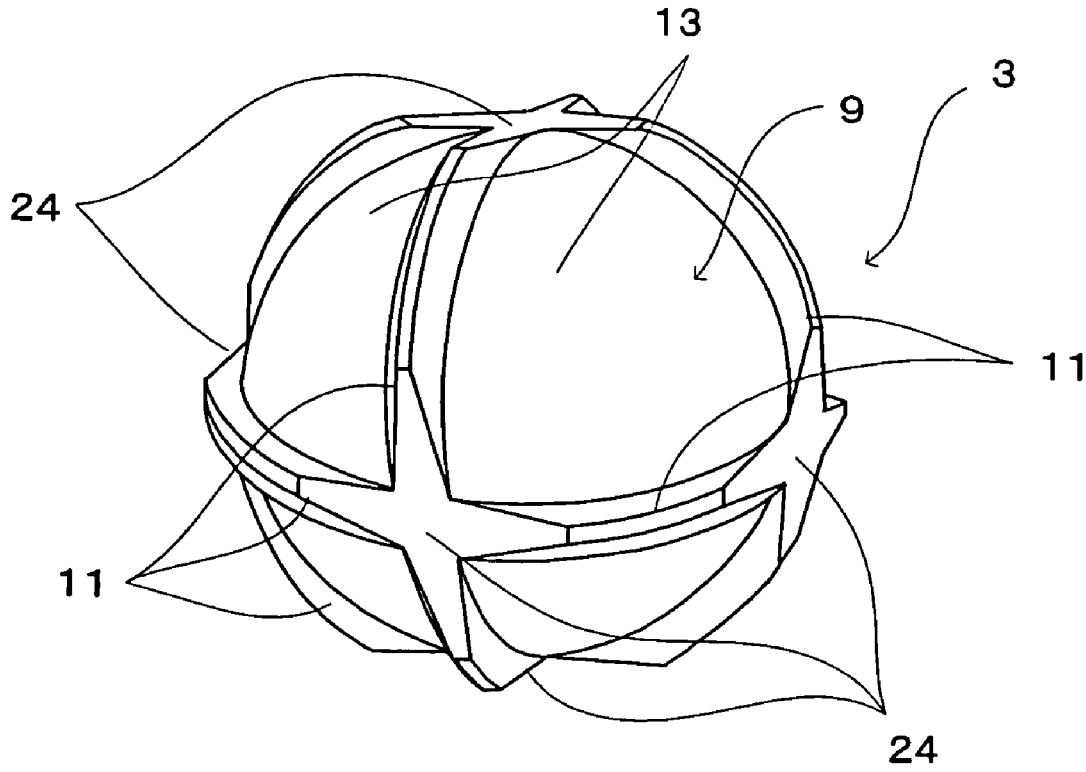
FIG. 7 is a perspective view illustrating another example of the core of the golf ball of the present invention.
Figure 8:
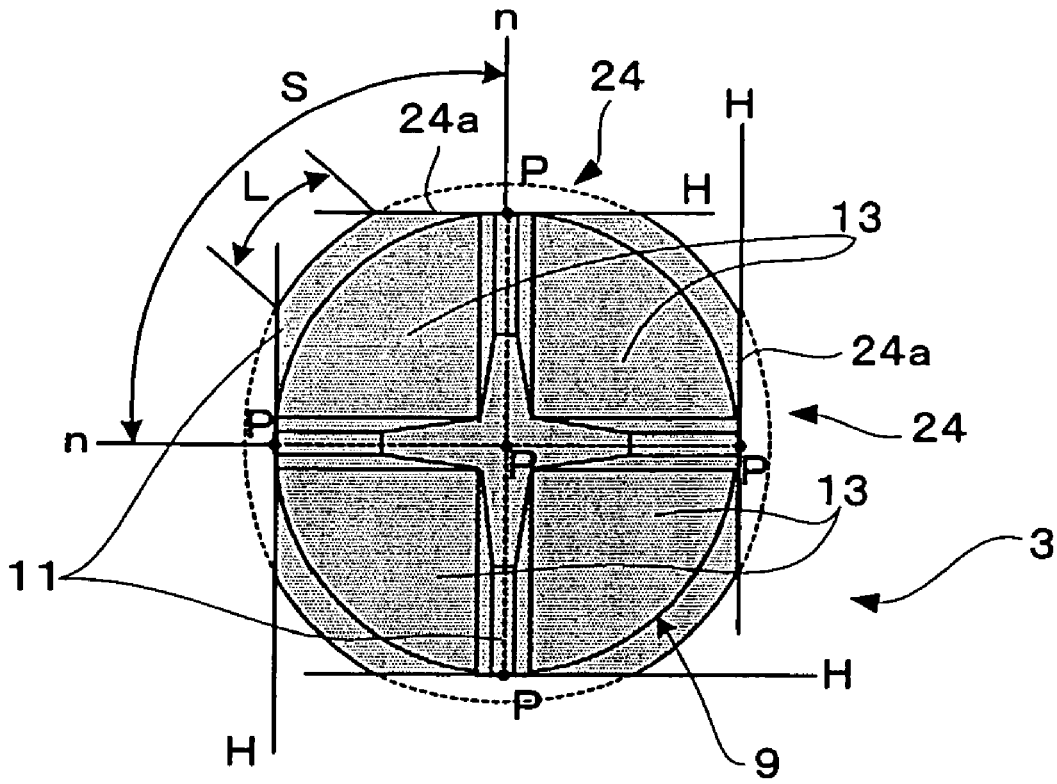
FIG. 8 is a front view showing the core of the golf ball of FIG. 7.
Figure 9:
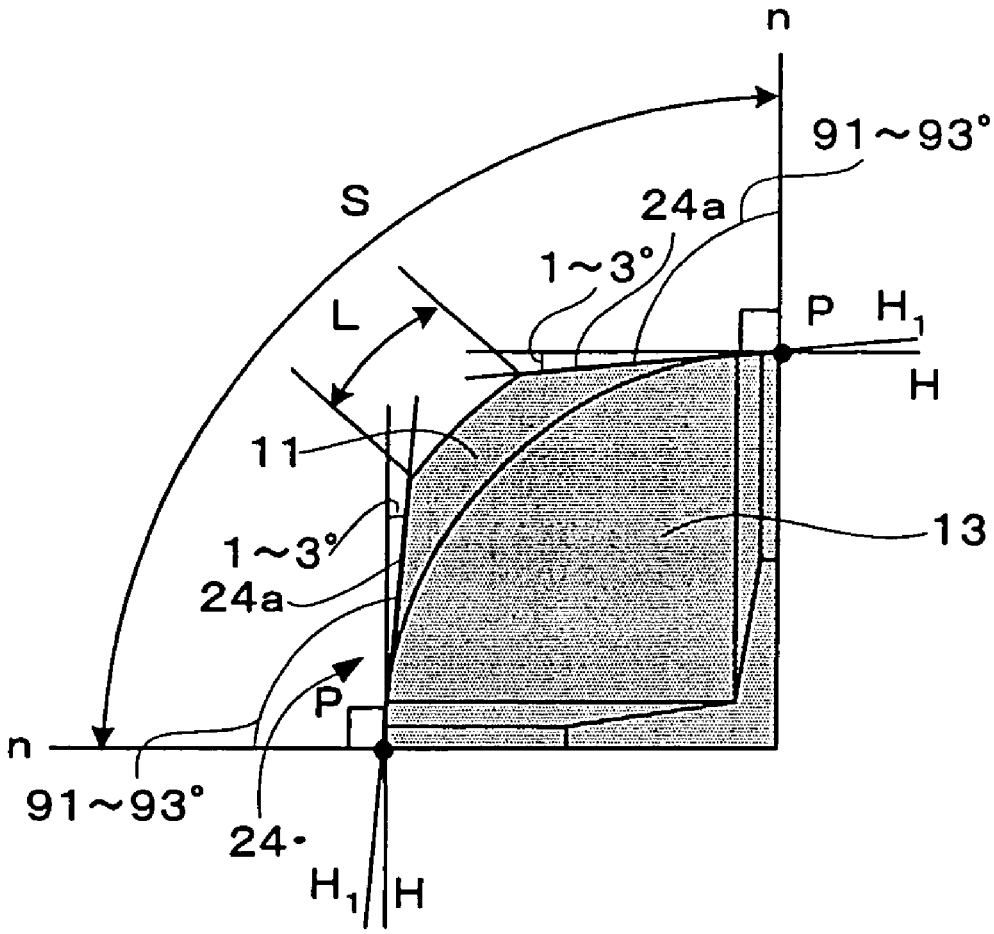
FIG. 9 is a front view illustrating another example of the core of the golf ball of the present invention.

FIG. 7 shows a perspective view of the core and FIG. 8 shows a cross-sectional view of the core. As shown in FIGS. 7 and 8, the notches 24 in this case are formed so as to have a base 24*a* extending along the tangent plane H that passes through the intersection P of the great circles. By forming the notches in this manner, even when the mold comprises two parts (an upper part of the mold and a lower part of the mold), the core can be easily removed from the mold. Furthermore, as shown in FIG. 9, it is also possible to form the base 24*a* of the notch 24 along the plane $H_1$, which is inclined relative to a tangent plane H toward the center side of the rib 11 at 1 to 3°, i.e., along the plane $H_1$, which has an angle of 91 to 93° from a front view relative to the normal line n of the spherical body 9 that passes through the intersection P. In this arrangement, the above inclination serves as a draft angle to make it easier to remove the core from the mold. However, if the inclination of the plane $H_1$, exceeds the above range, the length L of the upper end portion of the rib 11 in the circular direction without a notch becomes short. This reduces the effect of the rib on limiting the movable range of the intermediate layer, thus being undesirable.

To be more specific, in each circular arc section S of the rib 11 that is partitioned by each intersection P, it is preferable that the length L of the upper end portion of the rib 11 in the circular direction without a notch be no smaller than 10 mm. This is because, if the length L becomes smaller than 10 mm, it becomes difficult to limit the movable range of the intermediate layer as described above, reducing the ball bounce resilience.

Figure 10:
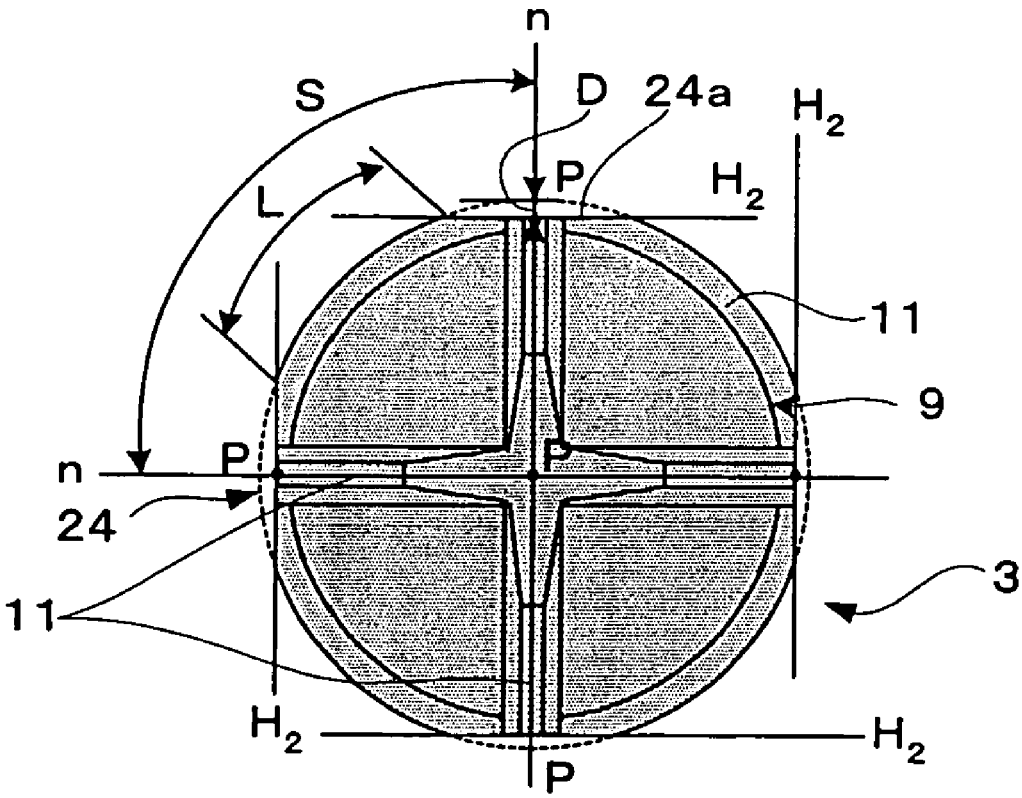
FIG. 10 is a front view illustrating another example of the core of the golf ball of the present invention.

Furthermore, as shown in FIG. 10, it is also possible to form the notches 24 so as to have a base 24*a* along the plane $H_2$ that is perpendicular to the normal line n that passes through the middle of the ribs 11 in the height direction. In this case, in order to smoothly distribute the intermediate layer to the concave portions 13, it is preferable that the notches 24 be formed under the condition that the distance D from the upper end portion of the virtual rib 11 without a notch 24 to the base 24*a* be no smaller than 1.2 mm. In order to achieve the effect of the rib, as described above, the length L should be no smaller than 10 mm. In this case, as shown in FIG. 9, it is also possible to form a draft angle by forming the base 24*a* of the notch 24 along the plane inclined at 91 to 93° relative to the normal line n.

Figure 11:
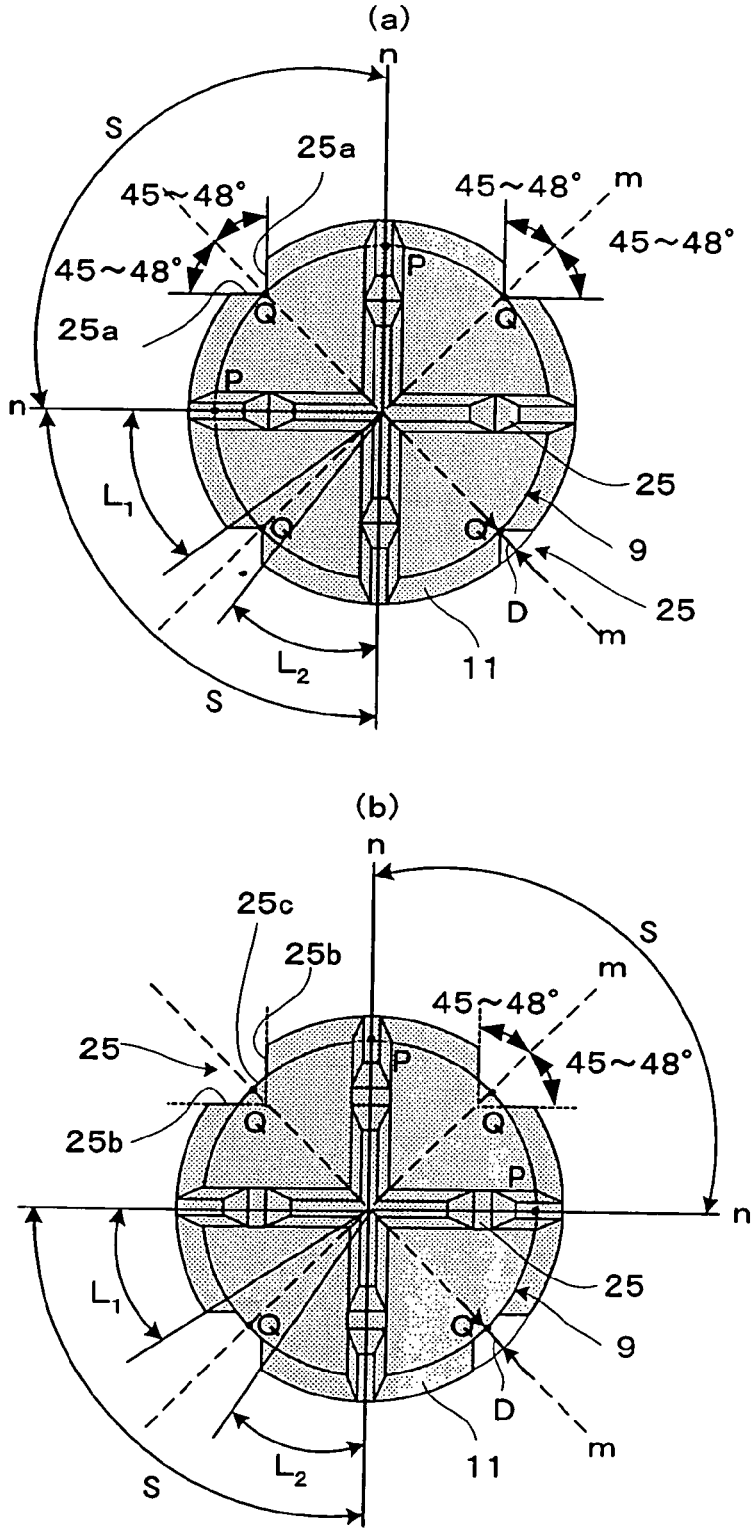
FIG. 11 is a front view illustrating another example of the core of the golf ball of the present invention.

It is also possible to provide a notch in the mid point of each circular arc section S of the ribs 11. In other words, as shown in FIG. 11(*a*), it is also possible to form a notch 25 so as to have two bases 25*a*, which extend from one point on the normal line m of the spherical body 9 that passes through the center Q of the circular arc section S in the circular direction toward the intersections P on both sides. In this case, it is preferable that the angle made between the base 25*a* and the normal line m be 45 to 48° as viewed from the front thereof. As described above, this arrangement makes it easier to remove the core 3 from the mold. However, if the above angle becomes larger than 48°, the length L of the rib in the circular direction becomes short, which is undesirable. It is preferable that the depth D of the notches 25 in this case be no less than 1.2 mm. The material for the intermediate layer can thus be made to smoothly communicate between the concave portions 13. Note that the depth D of the notches 25 is defined as the distance from the upper end portion of the virtual rib 11 without a notch 25 to the deepest portion of the notch 25.

Alternatively, as shown in FIG. 11(*b*), it is also possible to arrange the notches 25 so as to have side faces 25*b* along the two faces extending from one point on the normal line m of the spherical body 9 that passes through the midpoint Q of the circular arc section S in the circular direction toward the intersections P of both ends, and an arc base 25*c* that connects the two side faces 25*b* along the spherical body 9. As is true in the ribs shown in FIG. 11(*a*), the angle made between the side faces 25*b* and the normal line m should be 45 to 48° in consideration of the draft angle. Note that the base 25*c* can be structured so as to pass through the midpoint of the rib 11 in the height direction. In this case also, it is preferable that the depth D of the notch 25 be no less than 1.2 mm. Furthermore, as long as the shape allows for easy mold-releasing, it is possible to provide two or more notches in the midpoint of the circular arc section S.

Figure 12:
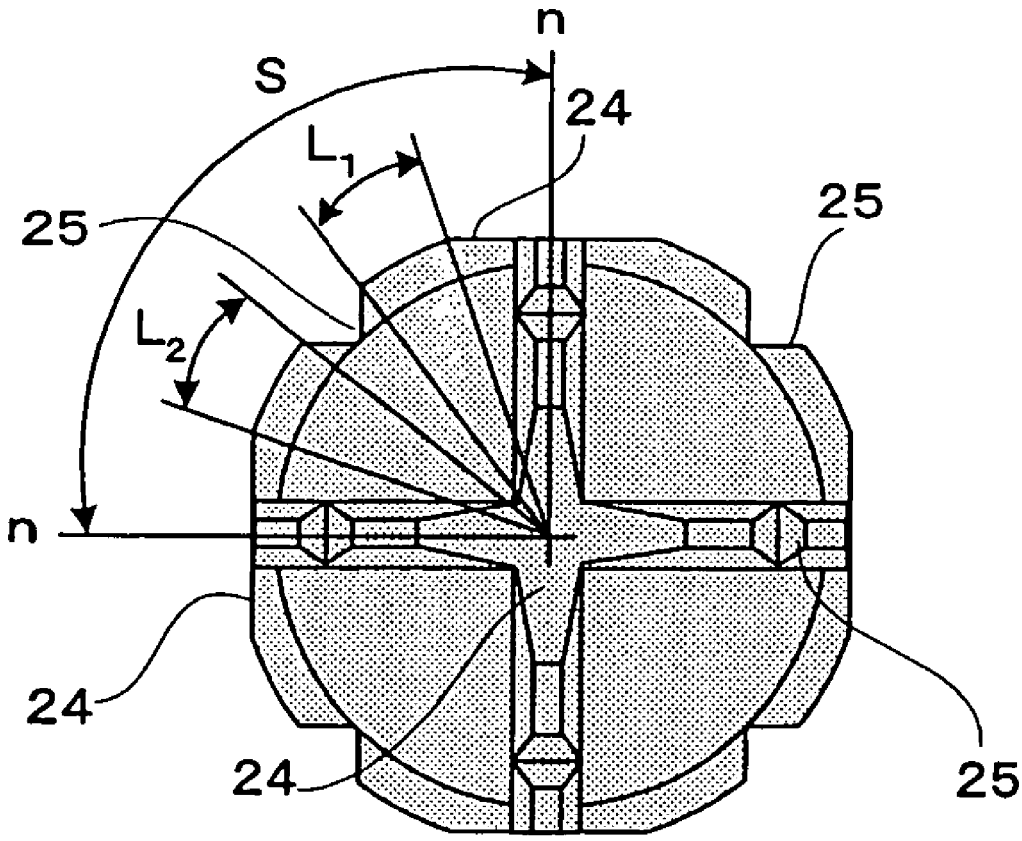
FIG. 12 is a front view illustrating another example of the core of the golf ball of the present invention.

Alternatively, as shown in FIG. 12, the circular arc section S can have both notches 24, as shown in FIG. 8, 9, or 10, and notches 25, as shown in FIG. 11. Note that, as shown in FIGS. 10 and 11, it is preferable that the length of the circular arc section S without a notch $L(=L_1+L_2)$ be no less than 10 mm.

In the present embodiment, the thickness of the intermediate layer and the height of the ribs are made equal; however, they do not necessarily need to be the same, and, for example, it is possible to make the thickness of the intermediate layer greater than the height of the ribs. However, in order to limit the movable range of the intermediate layer, it is preferable that the thickness of the intermediate layer be slightly greater than the height of the rib, for example, 1.5 mm or less.

Figure 13:
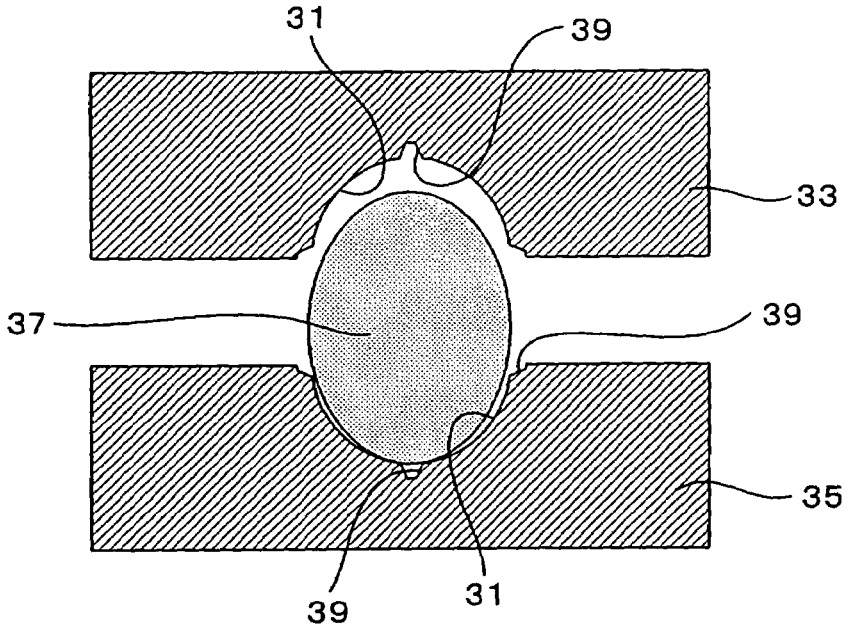
FIG. 13 illustrates an example of a manufacturing method of the golf ball of the present invention.
Figure 13:
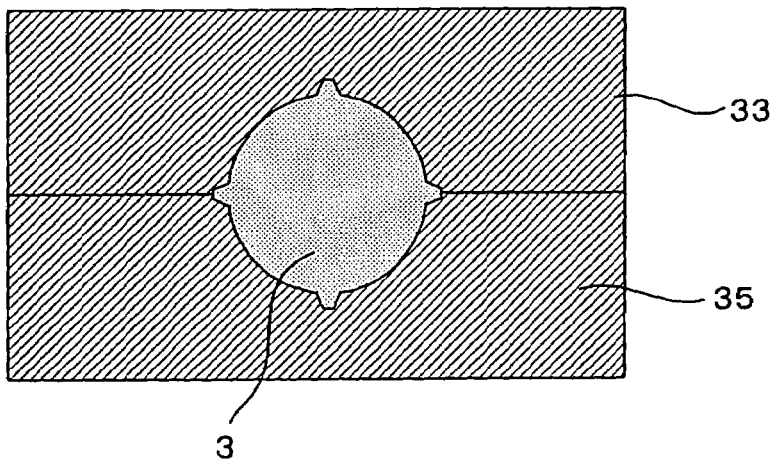
Figure 14:
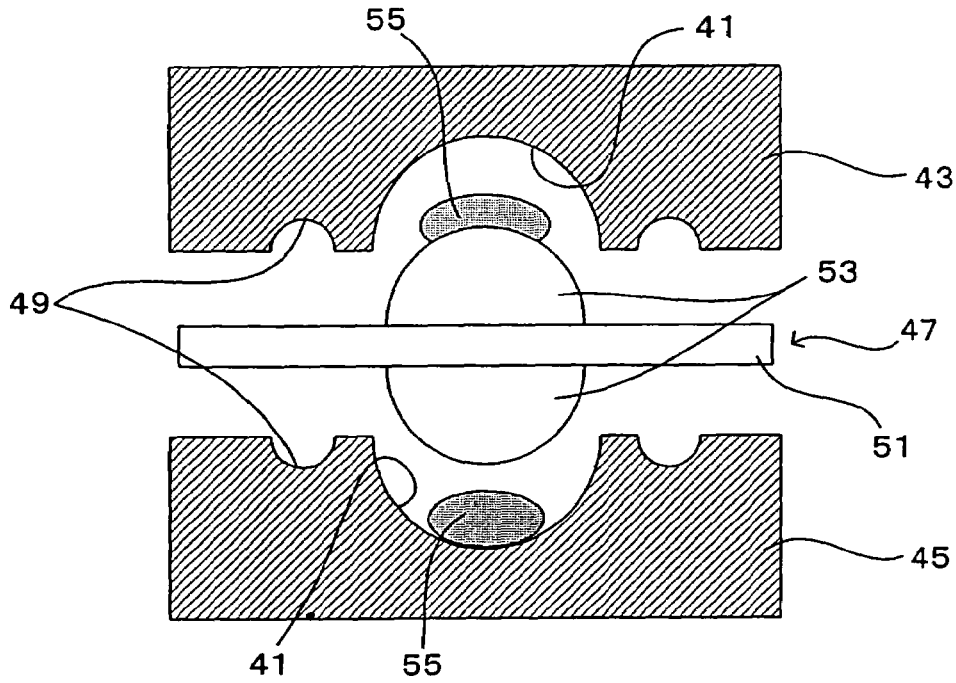
FIG. 14 illustrates an example of a manufacturing method of the golf ball of the present invention.
Figure 14:
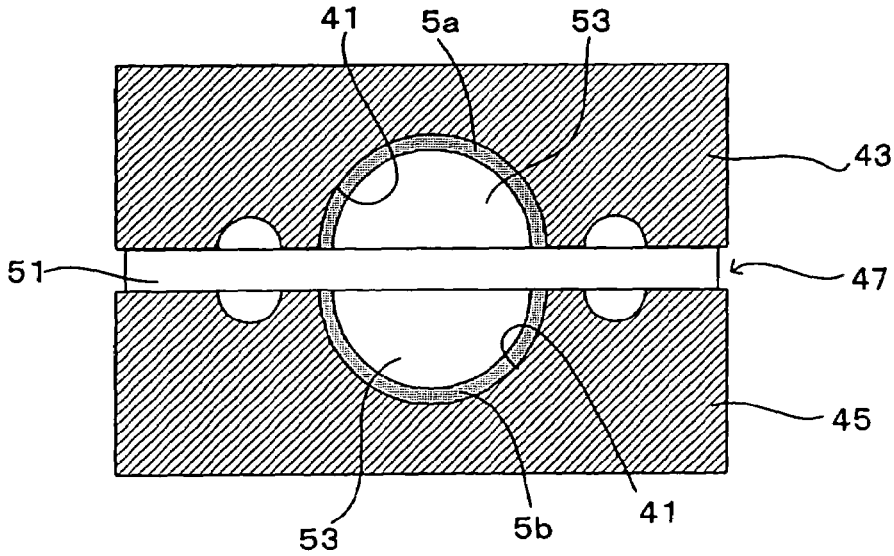
Figure 15:
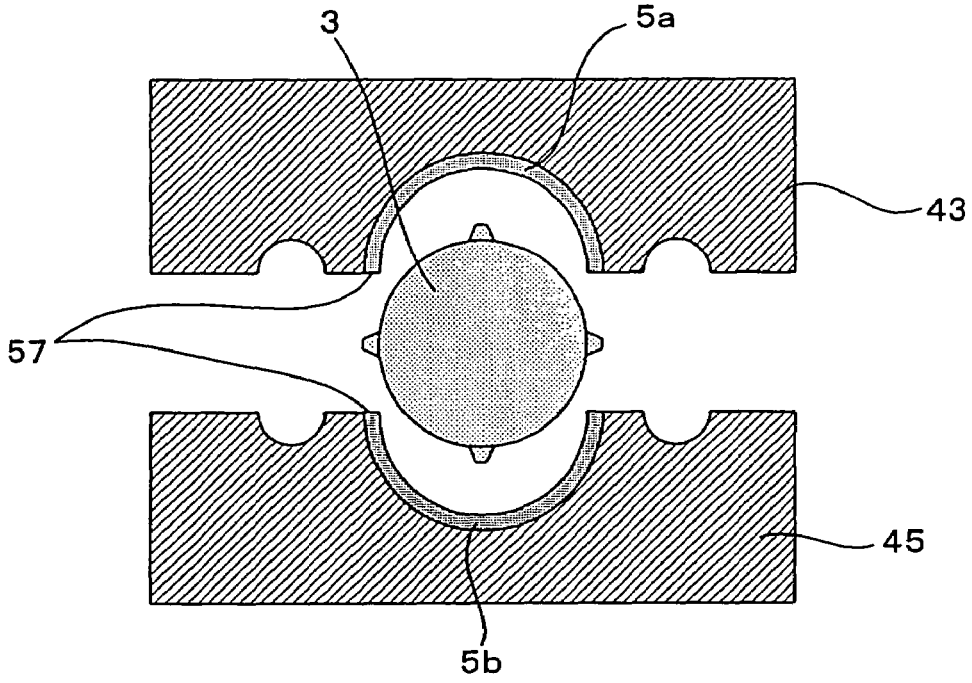
FIG. 15 illustrates an example of a manufacturing method of the golf ball of the present invention.
Figure 15:
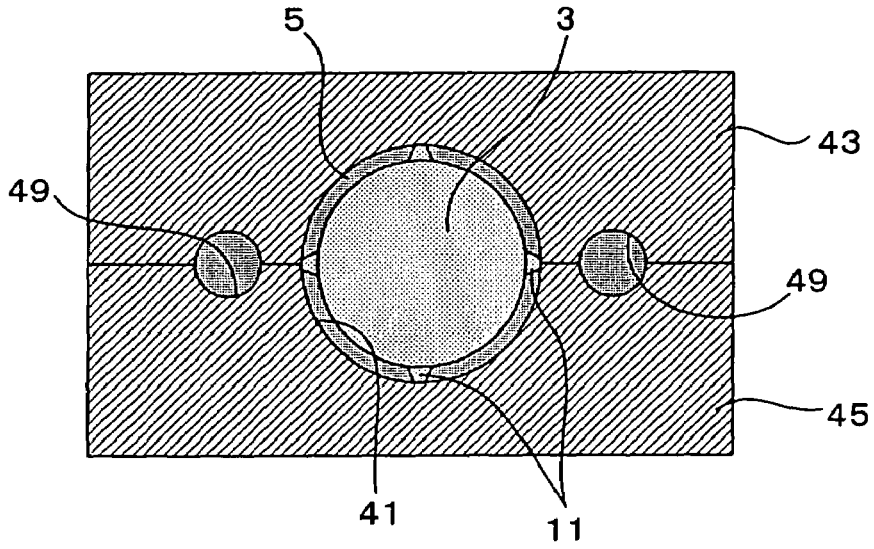

Next, the first embodiment of the manufacturing method of a golf ball that has the above-described structure will be explained by referring to the drawings. The following describes a manufacturing method wherein the intermediate layer is composed of a rubber composition. FIGS. 13 to 15 show a method for manufacturing the three-piece golf ball shown in FIG. 1.

First, as shown in FIG. 13, a predetermined amount of unvulcanized rubber composition 37 is placed between an upper part of the mold 33 and a lower part of the mold 35, each having a hemispherical concave portion 31. As described above, this rubber composition comprises a base rubber, a cross-linking agent, a metal salt of unsaturated carboxylic acid, and a filler, mixed by a Banbury mixer, rolls, or like mixing equipment. Then, this rubber composition is press molded at 130 to 180° C. and the core 3, as shown in FIG. 2, is obtained (the first process). The concave portions 31 of the upper part of the mold 33 and the lower part of the mold 35 have grooves 39, each having a trapezoidal profile in its sideways cross-section, that form three ribs 11. The surfaces of the concave portions 31 are roughly finished by rough grinding. By roughly finishing, it is possible to make fine irregularities on the surface of the obtained core 3, thus increasing the contact with the intermediate layer 5.

Then, a pair of hemispherical, shell-like pieces for the intermediate layer is molded by press molding. The mold for the pieces 5*a*, 5*b* for the intermediate layer comprises an upper part of the mold 43 and a lower part of the mold 45, each having a hemispherical concave portion 41, and a middle part of the mold 47 provided with a pair of hemispherical convex portions 53 as shown in FIG. 14(*a*). The concave portions 41 of the upper part of the mold 43 and the lower part of the mold 45 have the same kind of roughly finished surfaces as that of the mold for the core. Around each concave portion 41, a plurality of concave portions 49 for holding excess flow are formed. The middle part of the mold 47 comprises a separator 51 having a size that can cover the concave portions 41 of the upper part of the mold 43 and the lower part of the mold 45, and the above-described hemispherical convex portions 53 are provided on the upper and lower surfaces of the separator 51. Each convex portion 53 has a shape corresponding to the inner surface of the intermediate layer 5; in other words, it has the same diameter as that of the spherical body 9 of the core 3. Furthermore, as described later, in order to make the mold release more easily, a mold-releasing agent is applied to the entire surface of the middle part of the mold 47.

In molding the pieces 5*a*, 5*b* for the intermediate layer, as shown in FIG. 14(*a*), an unvulcanized rubber composition 55 is inserted in the concave portion 41 of the lower part of the mold 45 and a rubber composition 55 is placed on the convex portion 53 above the middle part of the mold 47, and then the middle part of the mold 47 is disposed between the upper part of the mold 43 and the lower part of the mold 45. Then, as shown in FIG. 14(*b*), the upper part of the mold 43 and the lower part of the mold 45 are brought into contact, and the rubber compositions are subjected to semi-vulcanization and press molding at 110 to 130° C. for 4 to 20 minutes (the second process). After a predetermined time period, the upper part of the mold 43 and the lower part of the mold 45 are separated and the middle part of the mold 47 is removed, simultaneously forming a pair of hemispherical, shell-like pieces 5*a*, 5*b* for the intermediate layer.

Here, the area where the pieces 5*a*, 5*b* for the intermediate layer are in contact with the concave portions 41 of the upper part of the mold 43 and the lower part of the mold 45 is wider than the area where the pieces 5*a*, 5*b* are in contact with the convex portions 53 of the middle part of the mold 47, and therefore the pieces 5*a*, 5*b* for the intermediate layer are prevented from being removed from the concave portions 41 together with the middle part of the mold 47. This facilitates smooth removal of the middle part of the mold 47. Furthermore, because the middle part of the mold 47 is covered with a mold-release agent and the surfaces of the concave portions 41 are roughly finished, the pieces 5*a*, 5*b* for the intermediate layer exhibit less mold-release resistance for the middle part of the mold 47 than for the upper part of the mold 43 and the lower part of the mold 45. This also contributes to the smooth mold releasing. Note that examples of mold-release agents for covering the middle part of the mold 47 include fluorine-based resin, silicon-based resin, etc.

Thereafter, as shown in FIG. 15(*a*), the core 3 obtained in the first process is inserted between the upper part of the mold 43 and the lower part of the mold 45 while the semi-vulcanized pieces 5*a*, 5*b* for the intermediate layer remain in the upper part of the mold 43 and the lower part of the mold 45. Then, the upper part of the mold 43 and the lower part of the mold 45 are brought into contact, and subjected to full vulcanization and press molding at 140 to 165° C. for 10 to 30 minutes (the third process). Here, the pieces 5*a*, 5*b* for the intermediate layer are in a semi-vulcanized condition and have an adequate hardness. Therefore, as shown in FIG. 15(*b*), they can hold the core inserted therein in an accurate concentric position. Furthermore, since these pieces are in a semi-vulcanized condition, when the edges of the mouths 57 of the pair of pieces 5*a*, 5*b* are joined by bringing the upper part of the mold 43 and the lower part of the mold 45 into contact, both pieces 5*a*, and 5*b* for forming the intermediate layer are cured and united into a single piece as the vulcanization progresses, thus resulting in a spherical intermediate layer 5.

Since the height of the ribs 11 is the same as the thickness of the intermediate layer 5, when the upper part of the mold 43 and the lower part of the mold 45 are brought into contact with each other, the top portions of the ribs 11 will come into contact with the surfaces of the concave portions 41 of the upper part of the mold 43 and the lower part of the mold 45. This also enables the core 3 and intermediate layer 5 to be concentrically manufactured in an accurate manner.

Moreover, since the inside diameter of the pieces 5*a*, 5*b* for forming the intermediate layer is the same as the outer diameter of the spherical body 9 of the core 3 as shown in FIG. 15(*b*), when press molding, a portion of the pieces 5*a*, 5*b* for forming the intermediate layer will overflow from the concave portions 41 of the upper part of the mold 43 and the lower part of the mold 45 in proportion to the volume of the ribs 11. However, this will flow into a portion 49 for holding the excess flow, and therefore it is easy to bring the upper part of the mold 43 and the lower part of the mold 45 into contact during press molding.

When the molding of the intermediate layer 5 is completed, the core 3 covered with the intermediate layer 5 is removed from the mold. Thereafter, a cover 7 is applied to the surface of the intermediate layer 5 by press molding or injection molding in such a manner that the cover has predetermined dimples, thus resulting in a three-piece golf ball.

As described above, in the present embodiment, the core 3 is inserted between the pair of semi-vulcanized hemispherical, shell-like pieces 5*a*, 5*b* for forming the intermediate layer, and subjected to press molding and full vulcanization. Here, the core is provided with an intermediate layer and ribs having almost the same height as the thickness of the intermediate layer, and therefore it is possible to accurately align the center of the core 3 with the center of the intermediate layer 5. Therefore, the complicated apparatus required in the known methods become unnecessary, reducing the production cost.

Furthermore, to obtain the intermediate layer 5, press molding is used, employing a mold comprising an upper part of the mold 43, a lower part of the mold 45, and a middle part of the mold 47 having a pair of convex portions 53, and therefore the pair of pieces 5*a*, 5*b* for forming the intermediate layer can be manufactured simultaneously. As a result, the manufacturing time can be reduced. In the present embodiment, the molding of the pieces for forming the intermediate layer and the molding of the intermediate layer are performed using the same mold; however, separate molds can be used. In other words, it is also possible to mold the pieces for the intermediate layer first, then mold the intermediate layer by placing them in a different mold and inserting the core therein.

In the present embodiment, the intermediate layer is obtained by two processes, i.e., the process of molding the pieces 5*a*, 5*b* for the intermediate layer in a semi-vulcanized condition and the process of attaching the resultant pieces by full vulcanization. However, by using a core as shown in FIG. 7, which has notches on the ribs, the intermediate layer can be molded in a single step. A second embodiment of the method for manufacturing the multi-piece golf ball of the present invention will be explained below.

First, as shown in FIG. 13, a core is press molded by following the same procedure as in the first embodiment (the first process).

Figure 16:
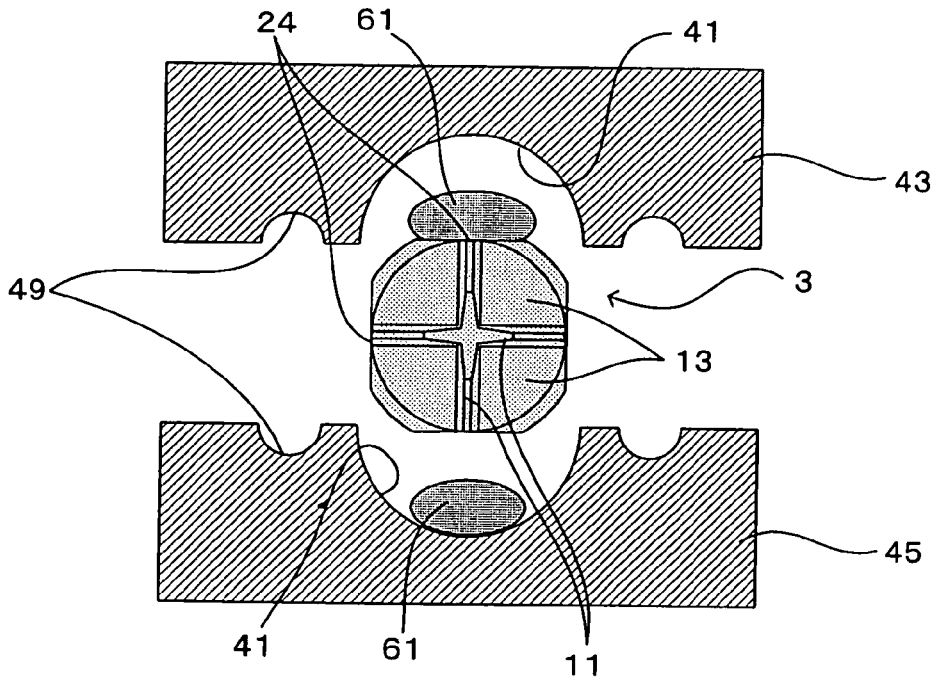
FIG. 16 illustrates another example of a manufacturing method of the golf ball of the present invention.
Figure 16:
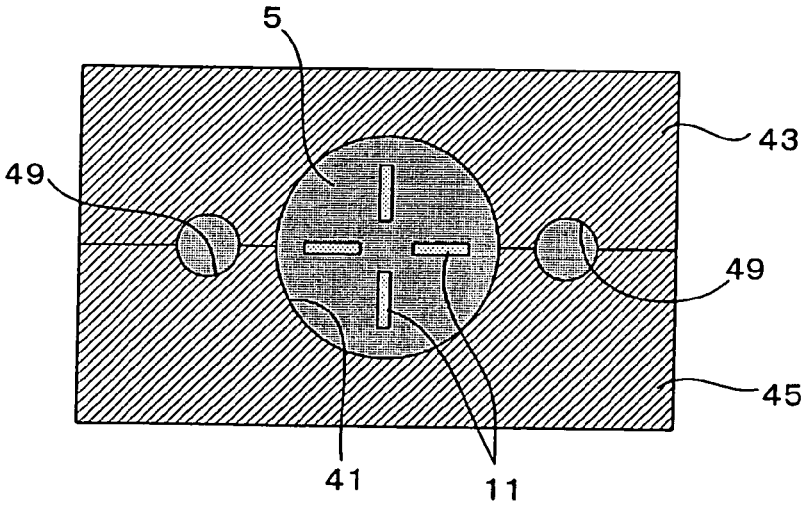

Then, as shown in FIG. 16, an intermediate layer 5 is press molded. The mold used for preparing the intermediate layer 5 is the same as that shown in FIG. 14, which comprises an upper part of the mold 43 and a lower part of the mold 45. As shown in FIG. 16(*a*), an unvulcanized rubber composition 61 is inserted in the concave portion 41 of the lower part of the mold 45 and a rubber composition 61 is placed on the core 3 obtained in the first process. Then, the core 3 is disposed between the upper part of the mold 43 and the lower part of the mold 45. Next, as shown in FIG. 16(*b*), the upper part of the mold 43 and the lower part of the mold 45 are brought into contact with each other and the rubber composition 61 is subjected to press molding while conducting full vulcanization at 140 to 165° C. for 10 to 30 minutes, thus forming the intermediate layer 5 (the third process).

At this time, the rubber compositions 61 placed on the core 3 and in the concave portion 41 of the lower part of the mold 45 fill the concave portions 13 while being pressed against the surface of the core 3. As described above, each two adjacent concave portions 13 communicate with each other through notches 24, and therefore the rubber composition spreads throughout the concave portions and uniformly fills the space therein.

Thereafter, the core 3 covered with the intermediate layer 5 is removed from the mold and the outer surface of the intermediate layer is covered with a cover 7 by press molding or injection molding, thus completing the golf ball.

As described above, in the present embodiment, the core 3 provided with ribs 11 having notches 24 is used, and therefore the following effect can be attained. That is, since the adjacent concave portions 13 communicate with each other through notches 24, the rubber composition 61 can fill the entire concave portions 13 regardless of the position on the surface of the core 3 on which the pressing is conducted. Therefore, the core 3 can be covered with the intermediate layer 5 in a single press molding step. As a result, the manufacturing time thereof can be significantly reduced.

In the above-described present embodiment, the core 3 shown in FIG. 7 is used. However, the scope of the present invention is not limited to these examples and the above-mentioned manufacturing method can be employed with any cores as long as they have notches so that the rubber compositions can spread throughout the concave portions during press molding.

However, using a core as shown in FIG. 7 is advantageous because the notches 24 are formed along the tangent planes that pass through the intersections of the great circles, and therefore, even when the mold comprises an upper part of the mold and a lower part of the mold, the mold can be easily released.

In each embodiment described above, the intermediate layer 5 is applied to the core 3 by press molding. However, when the above-described elastomers are used as the intermediate layer, it is possible to apply the intermediate layer by injection molding. In this case, gates are provided in the cavity of the injection mold, in positions that correspond to the concave portions. Then, in order to cover the core with the intermediate layer, the core is placed in the mold and the uncured intermediate layer material is injected into each concave portion through the gates. During this process, the core is positioned by bringing the ribs into contact with the inner surface of the cavity, and therefore the core 3 is covered with the intermediate layer while their centers are kept in alignment.

Figure 17:
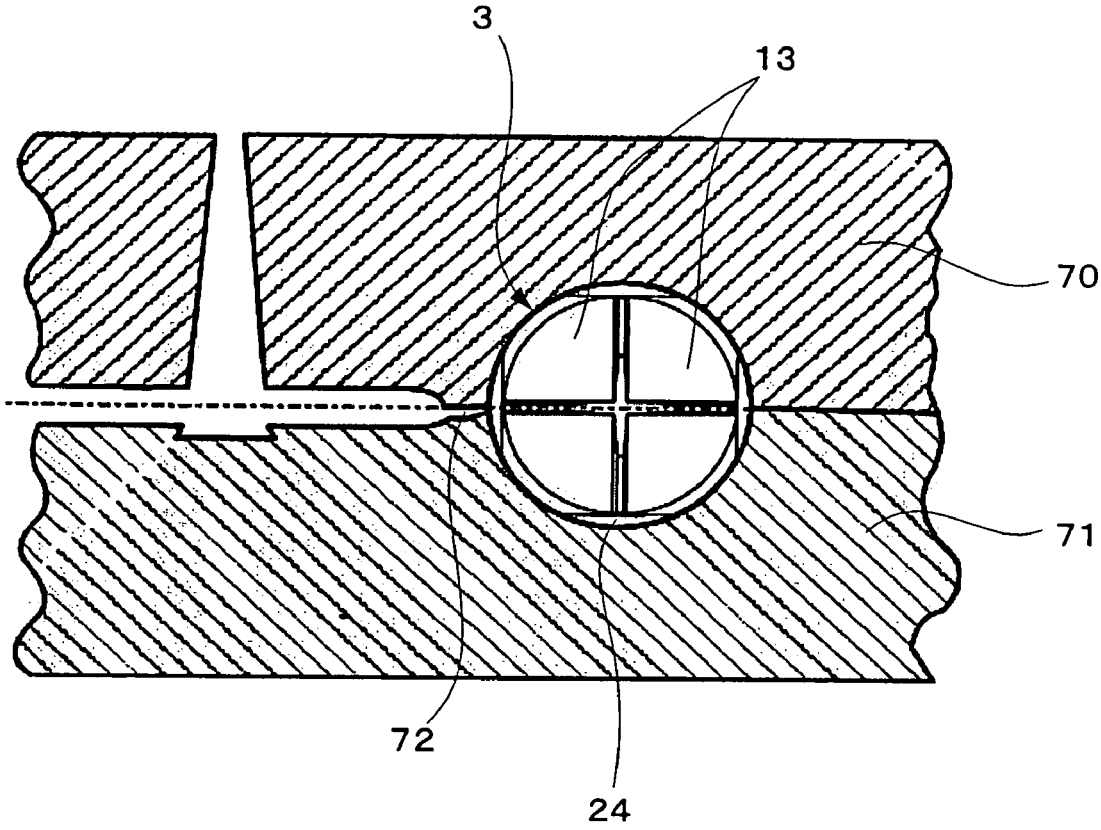
FIG. 17 illustrates another example of a manufacturing method of the golf ball of the present invention.

Specifically, by providing notches, it is possible to obtain an intermediate layer by using a mold that has a single gate, as shown in FIG. 17. In other words, the core 3 can be inserted between the two parts of the mold 70, 71, then a rubber composition can be injected from the single gate 72, and the rubber composition will evenly fill each concave portion 13 through the notches 24.

Figure 18:
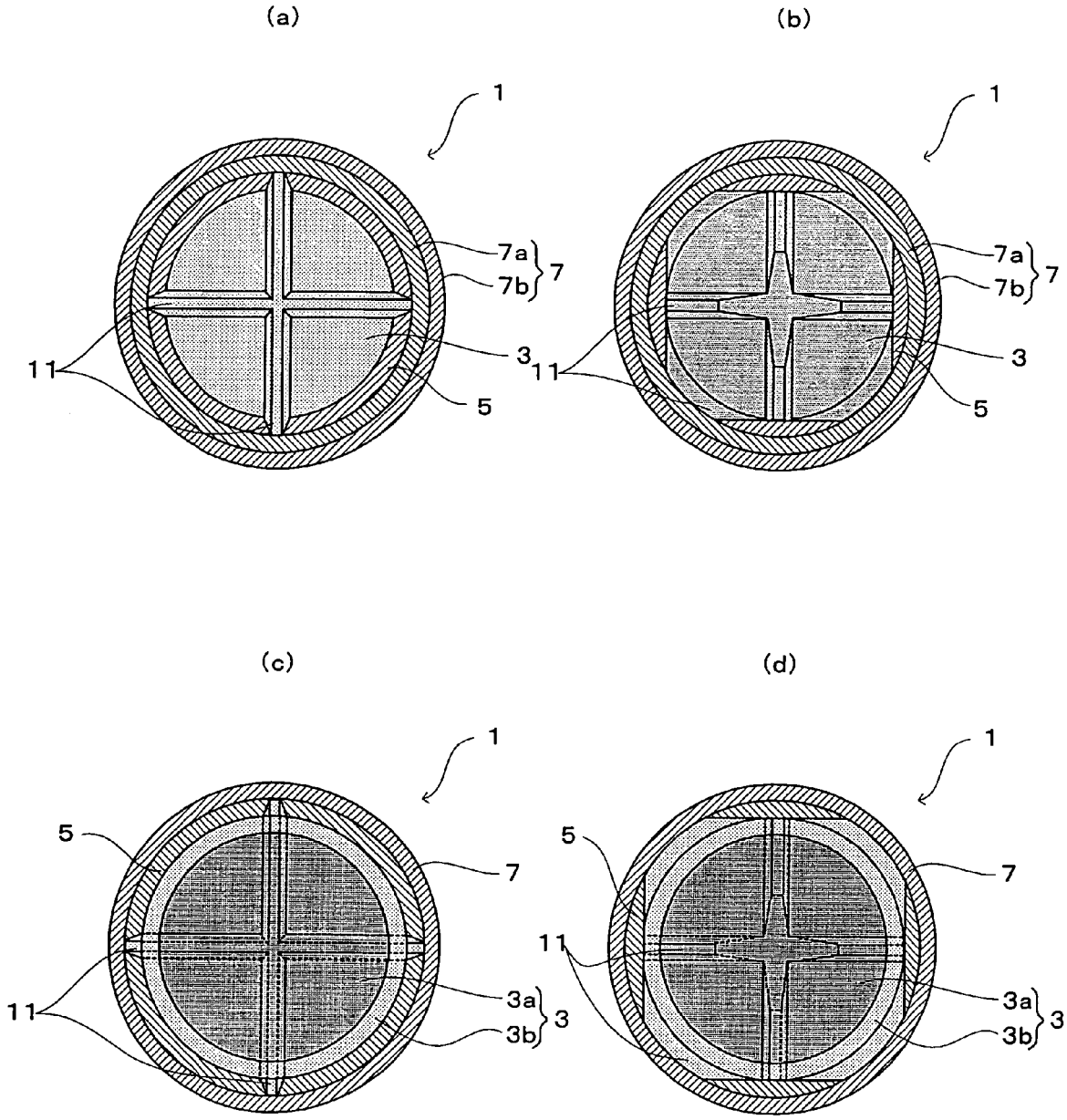
FIG. 18 illustrates another example of the golf ball of the present invention.

In the above embodiment, the method of the present invention is employed in manufacturing a three-piece golf ball. However, the scope of the present invention is not limited to these examples and can also be employed to manufacture a golf ball having a multilayer structure with four layers or more. For example, as shown in FIGS. 18(*a*) and 18(*b*), a four-piece golf ball can be obtained by using a two-layered structure 7*a*, 7*b* for the cover of the three-piece golf ball described above. In this case, for example, the core 3 can be formed of butadiene rubber, the intermediate layer 5 can be formed of butadiene rubber or elastomer, and the inner and outer covers 7*a*, 7*b* can be formed of elastomer.

It is also possible to obtain a four-piece golf ball by using a two-layered structure 3*a*, 3*b* for the core as shown in FIGS. 18(*c*) and 18(*d*). In this case, for example, the inner core 3*a* can be formed of butadiene rubber, the outer core 3*b* and the intermediate layer 5 can be formed of butadiene rubber or elastomer, and the cover 7 can be formed of elastomer.

As described above, the cores of the present invention include both single-layered cores and multi-layered cores. In either case, ribs are formed on the outermost layer. The covers of the present invention include all types of layers that cover the intermediate layer that has filled the concave portions of the core.

Figure 19:
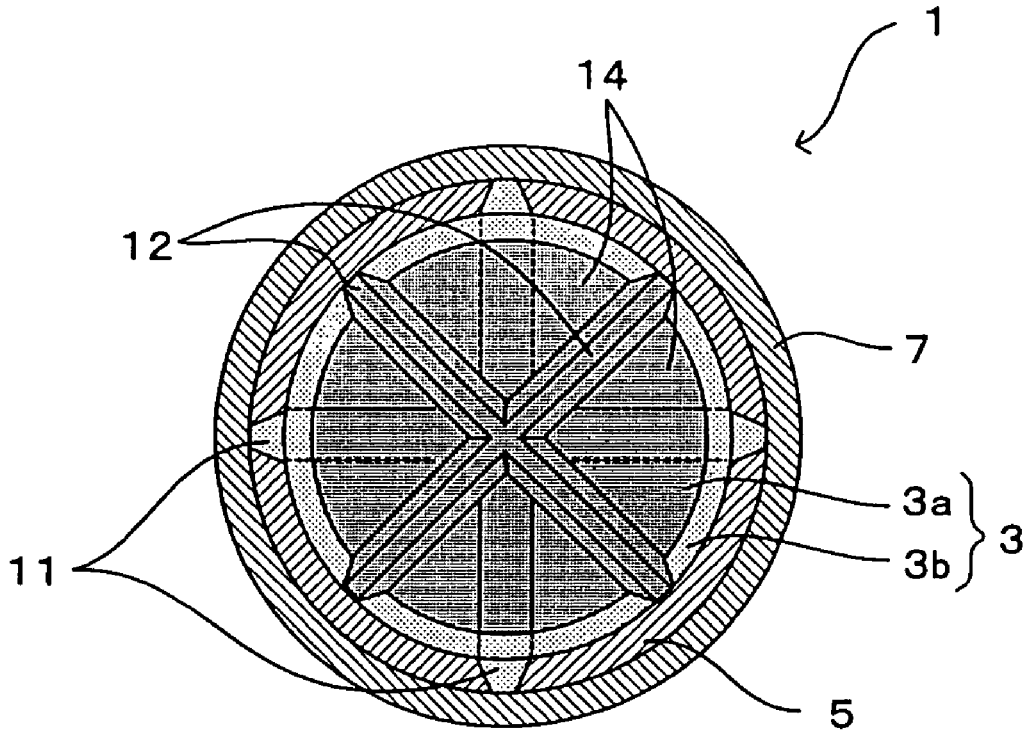
FIG. 19 illustrates still another example of the golf ball of the present invention.

It is also possible to design the core as described below so that the ribs have a two-staged structure in the radial direction. Specifically, as shown in FIG. 19, the core 3 is composed of an inner core 3a, and an outer core 3*b* that covers the inner core 3*a*. Ribs 12 are provided on the surface of the inner core 3*a*, and the outer core 3*b* fills the concave portions 14 that are surrounded by the ribs 12. The outer core 3*b* is also provided with ribs 11, wherein the ribs 11 are arranged so as not to overlap with the ribs 12 of the inner core 3*a*. This arrangement prevents portions having high hardness from being consecutively disposed in the radial direction.

EXAMPLES

Examples and Comparative Examples of the present invention will be explained below. Here, a comparison of three-piece golf balls is made between six types of golf balls made using the present invention, two types of golf balls having a rib height that is outside the range of the present invention, and two types of known golf balls having a core without ribs. The golf balls of Examples 1 to 6 and Comparative Examples 1 to 4 were all composed of the same materials, as shown in Table 1. The hardness of the layers in each Example and Comparative Example were the same, i.e., the core had a hardness of 80 on the JIS-C scale, the intermediate layer had a hardness of 70 on the JIS-C scale, and the cover had a Shore D hardness of 62.

TABLE 1

| Components | | |
|---|---|---|
| Layer | Ingredients | Parts by weight |
| Core | BR-11 (JSR Corporation) | 100 |
| | Zinc acrylate | 16 |
| | Zinc oxide | 20 |
| | Dicumyl peroxide | 2 |
| | Anti-oxidant | 0.5 |
| Intermediate layer | BR-11 (JSR Corporation) | 100 |
| | Zinc acrylate | 13 |
| | Zinc oxide | 25 |
| | Dicumyl peroxide | 2 |
| | Anti-oxidant | 0.5 |
| Cover | Surlyn 1706 (Mitsui-DuPont Polychemicals Co., Ltd.) | 50 |
| | Surlyn 1605 (Mitsui-DuPont Polychemicals Co., Ltd.) | 50 |

The size of each ball is as shown in Table 2. Each ball was press molded in such a manner as to have the components, proportions, and dimensions described above.

TABLE 2

| Dimensions | | | | | |
|---|---|---|---|---|---|
| | | Core | | Thickness of the | Thickness of the |
| | Structure | Spherical body diameter (mm) | Rib height (mm) | intermediate layer (mm) | cover (mm) |
| Ex. 1 | 3 piece (core with rib) | 36.8 | 1.2 | 1.2 | 1.75 |
| 2 | 3 piece (core with rib) | 36.2 | 1.5 | 1.5 | 1.75 |
| 3 | 3 piece (core with rib) | 35.2 | 2.0 | 2.0 | 1.75 |
| 4 | 3 piece (core with rib) | 34.4 | 2.4 | 2.4 | 1.75 |
| 5 | 3 piece (core with rib) | 31.2 | 4.0 | 4.0 | 1.75 |
| 6 | 3 piece (core with rib) | 30.0 | 4.6 | 4.6 | 1.75 |
| Comp. Ex. 1 | 3 piece (core without rib) | 37.2 | 1.0 | 1.0 | 1.75 |
| | 3 piece (core without rib) | 29.2 | 5.0 | 5.0 | 1.75 |
| | 3 piece (core without rib) | 35.2 | — | 2.0 | 1.75 |
| | 3 piece (core without rib) | 34.4 | — | 2.4 | 1.75 |

Using the golf balls obtained in the Examples and Comparative Examples described above, hitting tests were conducted using a hitting robot (manufactured by Miyamae Co., Ltd.) with a number one wood (1W) and a number five iron (5I), and tests of the feeling when hit were conducted by ten amateurs using a 1W. Table 3 shows the results.

TABLE 3

| Test results | | | | | | | |
|---|---|---|---|---|---|---|---|
| | Test using a robot | | | | | | |
| | 1W (head speed: 43 m/s) | | | 5I (head 3speed: 38 m/s) | | | |
| | Carry (m) | Total (m) | Spin amount (rpm) | Carry (m) | Total (m) | Spin amount (rpm) | Feel when actually hit |
| Example | | | | | | | |
| 1 | 203.3 | 219.0 | 2458 | 161.3 | 172.1 | 4600 | Excellent |
| 2 | 202.7 | 218.1 | 2471 | 161.4 | 172.1 | 4612 | Excellent |
| 3 | 203.0 | 218.0 | 2482 | 161.3 | 169.8 | 4891 | Excellent |
| 4 | 202.2 | 216.0 | 2602 | 158.7 | 165.4 | 4951 | Excellent |
| 5 | 201.3 | 215.1 | 2789 | 157.9 | 162.8 | 5011 | Excellent |
| 6 | 200.9 | 214.8 | 2811 | 157.5 | 162.8 | 5221 | Excellent |
| Comp. Example | | | | | | | |
| 1 | 203.5 | 219.0 | 2399 | 161.0 | 171.4 | 4492 | Hard |
| 2 | 196.1 | 209.4 | 2902 | 155.7 | 162.4 | 5536 | Too soft |
| 3 | 199.2 | 214.2 | 2502 | 160.8 | 169.8 | 4602 | Excellent |
| 4 | 196.3 | 209.4 | 2788 | 158.5 | 168.1 | 4855 | Too soft |

In the first test using the hitting robot, a 1W was used and the head speed was set at 43 m/s. Balls obtained in Examples 1 to 6 and Comparative Example 1, which included ribs, exhibited longer carry distances compared to the balls without ribs. However, the balls with ribs obtained in Comparative Example 2 had too thick of an intermediate layer and exhibited low ball bounce resilience, thus failing to achieve along carry distance.

In the second test, a 5I was used and the head speed was set at 38 m/s. The results of Examples and Comparative Examples showed little difference in the carry distance. However, the balls with ribs showed greater spin amounts than those without ribs.

In the tests of the feel when actually hit (the third test), Examples 1 to 6 showed excellent results. On the other hand, Comparative Example 1 had a thin intermediate layer and exhibited a hard feel when hit, Comparative Example 2 had too thick of an intermediate layer and exhibited too a soft of a feel when hit. Comparative Example 4 did not have ribs and a had thick intermediate layer, thus resulting in too soft feel when hit.

As described above, it is clear that the golf balls of the present invention achieve long carry distances and high spin amounts, as well as an excellent feel when hit, and therefore they are superior to those obtained in the Comparative Examples.

The invention claimed is:

1. A method for manufacturing a multi-piece golf ball having a core, an intermediate layer, and a cover comprising:

a first process of molding the core having a spherical body and ribs arranged on the surface of the spherical body, each rib having at least one notch;

a second process of forming an intermediate layer in the notches and a plurality of concave portions surrounded by the ribs, the intermediate layer having a thickness that is almost the same as the height of the rib; and a third process of providing a cover over the intermediate layer.

2. The method for manufacturing the multi-piece golf ball according to claim 1, wherein the second process comprises the steps of:

a process of preparing an upper part and lower part of the mold each provided with a hemispheric concave portion; and a process of molding the intermediate layer in the notches and a plurality of concave portions surrounded by the ribs by injection molding after inserting the core between the upper part and lower part of the mold.

3. The method for manufacturing the multi-piece golf ball according to claim 1, wherein the thickness of the cover is 0.8 to 2.4 mm;

the ribs are structured so as to extend along three great circles drawn on the spherical body in such a manner as to intersect each other at right angles, and have a height of 1.2 to 4.6 mm;

each circular arc section partitioned by the intersections of the great circles is provided with a notch or notches;

the length of the upper end portion in each circular arc section without a notch is no smaller than 10 mm and the depth of each notch is no smaller than 1.2 mm; and the intermediate layer fills eight concave portions surrounded by the ribs and disposed between the cover and the surface of the spherical body, the second process comprising:

a process of preparing an upper part and lower part of the mold each having a hemispherical concave portion; and a process of molding the intermediate layer in the notches and a plurality of concave portions surrounded by the ribs by injection molding after inserting the core between the upper part and lower part of the mold.

4. A method for manufacturing a multi-piece golf ball having a core, an intermediate layer and a cover comprising:

a first process of molding the core having a spherical body and ribs arranged on the surface of the spherical body, each rib having at least one notch;

a second process of forming an intermediate layer in the notches and a plurality of concave portions surrounded by the ribs, the intermediate layer having a thickness that is almost the same as the height of the rib, the second process comprises the steps of:

a process of press molding a pair of hemispherical, shell-like pieces for forming the intermediate layer, wherein the pieces are composed of a rubber composition in a semi-vulcanized condition; and a process in which the core is placed between the pair of pieces for forming the intermediate layer, the edges of mouths of the pair of the pieces for forming the intermediate layer are put into contact with each other, and the pieces for forming the intermediate layer are fully vulcanized by press molding so that the intermediate layer is formed; and a third process of providing a cover over the intermediate layer.

5. A method for manufacturing a multi-piece golf ball having a core, an intermediate layer, and a cover comprising:

a first process of molding the core having a spherical body and ribs arranged on the surface of the spherical body;

a second process of forming an intermediate layer in a plurality of concave portions surrounded by the ribs, the intermediate layer having a thickness that is almost the same as the height of the rib, the second process comprising the steps of:

a process of press molding a pair of hemispherical, shell-like pieces for forming the intermediate layer, wherein the pieces are composed of a rubber composition in a semi-vulcanized condition, the process of press molding a pair of hemispherical, shell-like pieces for comprising the steps of:

preparing an upper part and lower part of the mold each provided with a hemispheric concave portion;

preparing a middle part of the mold provided with a separator having a size that can cover the concave portions of the upper part and lower part of the mold, and a pair of hemispheric convex portions each arranged on the upper surface and the lower surface of the separator that are shaped so as to correspond to the inner surface of the intermediate layer; and molding the pieces for forming the intermediate layer in the semi-vulcanized condition by placing the middle part of the mold between the upper part and lower part of the mold, filling the concave portions of the upper part and lower part of the mold with the material for the intermediate layer, and press molding; and a process in which the core is placed between the pair of pieces for forming the intermediate layer, the edges of mouths of the pair of the pieces for forming the intermediate layer are put into contact with each other, and the pieces for forming the intermediate layer are fully vulcanized by pressed molding so that the intermediate layer is formed; and a third process of providing a cover over the intermediate layer.

6. A method for manufacturing a multi-piece golf having a core, and intermediate layer, and a cover comprising:

a first process of molding the core having a spherical body and ribs arranged on the surface of the spherical body; said process forming at least one notch in each rib;

a second process forming an intermediate layer in a plurality of concave portions surrounded by the ribs, the intermediate layer having a thickness that is almost the same as the height of the rib, said second process comprises the steps of:

a process of preparing an upper part and lower part of the mold each provided with a hemispheric concave portion; and a process of molding the intermediate layer in notches and a plurality of concave portions surrounded by the ribs by inserting the core between the upper part and lower part of the mold, filling the concave portions of the upper part and lower part of the mold with the material for the intermediate layer that is composed of a rubber composition, press molding so that the material for the intermediate layer spreads throughout the plurality of concave portions surrounded by the ribs through the notches; and a third process of providing a cover over the intermediate layer.

7. A method for manufacturing a multi-piece golf ball having a core, an intermediate layer, and a cover comprising:

a first process of molding the core having a spherical body and ribs arranged on the surface of the spherical body;

a second process of forming an intermediate layer in a plurality if concave portions surrounded by the ribs, the intermediate layer having a thickness that is almost the same as the height of the rib, said second process comprising:

a process of preparing an upper part and lower part of the mold each provided with a hemispheric concave portion; and a process of molding the intermediate layer in notches and a plurality of concave portions surrounded by the ribs by inserting the core between the upper part and lower part of the mold, filling the concave portions of the upper part and lower part of the mold with the material for the intermediate layer that is composed of a rubber composition, press molding so that the material for the intermediate layer spreads throughout the plurality of concave portions surrounded by the ribs through the notches; and a third process of providing a cover over the intermediate layer, wherein the thickness of the cover is 0.8 to 2.4 mm;

the ribs are structured so as to extend along three great circles drawn on the spherical body in such a manner as to intersect each other at right angles, and have a height of 1.2 to 4.6 mm;

each circular arc section partitioned by the intersections of the great circles is provided with a notch or notches;

the length of the upper end portion in each circular arc section without a notch is no smaller than 10 mm and the depth of each notch is no smaller than 1.2 mm; and the intermediate layer fills eight concave portions surrounded by the ribs and disposed between the cover and the surface of the spherical body.

* * * * *

UNITED STATES PATENT AND TRADEMARK OFFICE

CERTIFICATE OF CORRECTION

PATENT NO. : 7,169,065 B2
APPLICATION NO. : 10/767008
DATED : January 30, 2007
INVENTOR(S) : Ninomiya et al.

It is certified that error appears in the above-identified patent and that said Letters Patent is hereby corrected as shown below:

On the title page under data section (62) Related U.S. Application Data:
Change "Jan. 10, 2004" to --Jan. 10, 2003--.

In column 1, lines 4 and 5:
Change "This is a divisional of application Ser. No. 10/339,411, filed Jan. 10, 2004." to --This is a divisional of application Ser. No. 10/339,411, filed Jan. 10, 2003.--

Signed and Sealed this

Third Day of April, 2007

JON W. DUDAS
*Director of the United States Patent and Trademark Office*